US007126444B2

(12) United States Patent
Fukunaga et al.

(10) Patent No.: US 7,126,444 B2
(45) Date of Patent: Oct. 24, 2006

(54) MULTI-LAYER BAND-PASS FILTER

(75) Inventors: Tatsuya Fukunaga, Tokyo (JP); Hideya Matsubara, Tokyo (JP); Shinichiroh Toda, Tokyo (JP)

(73) Assignee: TDK Corporation, Tokyo (JP)

( * ) Notice: Subject to any disclaimer, the term of this patent is extended or adjusted under 35 U.S.C. 154(b) by 44 days.

(21) Appl. No.: 10/929,485

(22) Filed: Aug. 31, 2004

(65) Prior Publication Data

US 2005/0052262 A1 Mar. 10, 2005

(30) Foreign Application Priority Data

Sep. 4, 2003 (JP) ..... 2003-312119

(51) Int. Cl.
*H01P 1/20* (2006.01)

(52) U.S. Cl. ..... 333/204; 333/212

(58) Field of Classification Search ..... 333/212, 333/206, 202, 204

See application file for complete search history.

(56) References Cited

U.S. PATENT DOCUMENTS

| | | | | |
|---|---|---|---|---|
| 5,572,174 | A * | 11/1996 | Kitaichi et al. | 333/206 |
| 5,719,539 | A * | 2/1998 | Ishizaki et al. | 333/204 |
| 6,294,965 | B1 | 9/2001 | Merrill et al. | |
| 6,351,192 | B1 | 2/2002 | Sheen | |
| 6,351,239 | B1 * | 2/2002 | Mizuno et al. | 343/700 MS |
| 6,352,239 | B1 | 3/2002 | McIntosh et al. | |
| 6,359,529 | B1 * | 3/2002 | Tsunoda et al. | 333/101 |
| 6,420,942 | B1 | 7/2002 | Hiroshima et al. | |
| 6,426,725 | B1 * | 7/2002 | Hiroshima et al. | 343/741 |
| 6,448,864 | B1 * | 9/2002 | Hiroshima et al. | 333/26 |
| 6,535,077 | B1 | 3/2003 | Hiroshima et al. | |
| 6,914,512 | B1 * | 7/2005 | Park et al. | 336/232 |
| 2003/0020568 | A1 | 1/2003 | Mizutani et al. | |
| 2004/0095212 | A1 * | 5/2004 | Iwasaki et al. | 333/204 |

FOREIGN PATENT DOCUMENTS

| | | |
|---|---|---|
| EP | 1 045 469 A2 | 10/2000 |
| JP | A 2000-22404 | 1/2000 |
| JP | A 2000-217616 | 8/2000 |
| JP | A 2000-349505 | 12/2000 |
| JP | A 2000-353904 | 12/2000 |
| JP | A 2003-87008 | 3/2003 |

* cited by examiner

*Primary Examiner*—Robert Pascal
*Assistant Examiner*—Kimberly E Glenn
(74) *Attorney, Agent, or Firm*—Oliff & Berridge, PLC

(57) ABSTRACT

A multi-layer band-pass filter comprises an unbalanced input, two balanced outputs, and a band-pass filter section provided between the unbalanced input and the two balanced outputs. The band-pass filter section incorporates a plurality of resonators each of which is made up of a TEM line. The band-pass filter further comprises a multi-layer substrate used for integrating the resonators. The band-pass filter section incorporates, as the resonators, an input resonator, and a half-wave resonator for balanced output that is made up of a half-wave resonator having open-circuited ends. The unbalanced input is connected to the input resonator through a capacitor. Each of the balanced outputs is connected to the half-wave resonator through a capacitor.

14 Claims, 30 Drawing Sheets

MULTI-LAYER BAND-PASS FILTER

BACKGROUND OF THE INVENTION

1. Field of the Invention

The present invention relates to a multi-layer band-pass filter having balanced outputs.

2. Description of the Related Art

Reductions in size and thickness of radio communications devices such as cellular phones have been strongly sought, and techniques for mounting components with higher density have been therefore required. Integration of components through the use of a multi-layer substrate has been thus proposed.

One of the components of radio communications devices is a band-pass filter for filtering reception signals. A known type of such a band-pass filter is a multi-layer band-pass filter as disclosed in the Published Unexamined Japanese Patent Application 2003-87008. This multi-layer band-pass filter comprises a resonator made up of conductor layers of a multi-layer substrate.

A conventional multi-layer band-pass filter is designed to receive and output unbalanced signals of which ground potential is the reference potential. Therefore, to give an output signal of this band-pass filter to a balanced-input amplifier, an unbalance-to-balance transformer (balun) is required for transforming an unbalanced signal to a balanced signal made up of two signals that are nearly 180 degrees out of phase with each other and have nearly equal amplitudes. It is possible to make this balun using conductor layers of a multi-layer substrate, too.

Conventionally, the above-mentioned band-pass filter and balun are designed as discrete circuits. The Published Unexamined Japanese Patent Application 2003-87008 discloses a multi-layer dielectric filter wherein a filter and a balun are integrated through the use of a multi-layer substrate.

The Published Unexamined Japanese Patent Application 2000-349505 discloses a dielectric filter which enables receiving and outputting balanced signals without using a balun. The dielectric filter comprises: a half-wave resonator having ends open-circuited or short-circuited; a quarter-wave resonator having an end short-circuited and the other end open-circuited; an unbalanced terminal coupled to the quarter-wave resonator; and two balanced terminals coupled to portions near the two open-circuited ends of the half-wave resonator, respectively.

If the band-pass filter and the balun are made as discrete circuits, the number of components is large so that there arises a problem that the circuitry including the band-pass filter and the balun suffers greater loss and has greater dimensions. Although the multi-layer dielectric filter disclosed in the Published Unexamined Japanese Patent Application 2003-87008 has the filter and the balun integrated through the use of the multi-layer substrate, the filter and the balun are discrete circuits. Therefore, this multi-layer dielectric filter is not capable of solving the above-mentioned problem.

In the dielectric filter disclosed in the Published Unexamined Japanese Patent Application 2000-349505, the two balanced terminals are located at a distance from the half-wave resonator, and coupled to the half-wave resonator through capacitance produced between the half-wave resonator and the respective balanced terminals.

One of important parameters for determining the filter characteristics is an external Q. The external Q is Q of a resistor of an external circuit connected to the resonator. The external Q affects the acuteness of the resonance property of the resonator. The magnitude of the external Q depends on the intensity of coupling between the resonator and the external circuit. Specifically, the greater the intensity of the coupling, the smaller is the external Q.

Reference is now made to FIG. 42 to describe the relationship between the capacitance of a capacitor and an external Q obtained when a signal source is connected to a resonator through the capacitor. Here, by way of example, the resonator is a quarter-wave resonator. The circuit of FIG. 42 comprises the quarter-wave resonator 501 having an end short-circuited and the other end open-circuited. An end of the signal source 503 is connected through the capacitor 502 to the open-circuited end of the quarter-wave resonator 501. The other end of the signal source 503 is grounded through a resistor 504. The resistor 504 represents resistors of the external circuit connected to the quarter-wave resonator 501 through the capacitor 502, such as an internal resistor of the signal source 503.

The external Q of the resonator 501, expressed as $Q_e$, is given by the following equation, where the characteristic impedance of the quarter-wave resonator 501 is $Z_0$, the capacitance of the capacitor 502 is $C_c$, the angular frequency of a signal outputted from the signal source 503 is ω, and the resistance of the resistor 504 is R, wherein $Q_c=\omega C_c R$.

$$Q_e=(R\pi/4Z_0)(1+1/Q_c^2)+1/Q_c$$

As the equation shows, the greater the capacitance $C_c$, the smaller is the value of $Q_e$, that is, the greater is the coupling between the resonator 501 and the signal source 503.

Once the filter characteristics such as the center frequency, the frequency band, the number of stages, and the magnitude of ripple are determined, the external Q required is determined. If the resistance R is low, it is not necessary that the capacitance $C_c$ is high, and it is therefore relatively easy to adjust $Q_e$. However, if the resistance R is high, high capacitance $C_c$ is required to obtain a desired $Q_e$. To increase the frequency band of the filter, it is required to reduce $Q_e$. A high capacitance $C_c$ is required, too, in this case.

According to the dielectric filter disclosed in the Published Unexamined Japanese Patent Application 2000-349505, a terminal electrode is provided on an external surface of a dielectric block, and capacitance is produced between the terminal electrode and an internal conductor. It is difficult to obtain a high capacitance in such a configuration because of the following reason. The capacitance produced between the terminal electrode and the internal conductor is proportional to the area of the terminal electrode, and inversely proportional to the space between the terminal electrode and the internal conductor. However, it is difficult to increase the area of the terminal electrode in view of the size of the dielectric filter. In addition, if the thickness of a portion of the dielectric block between the terminal electrode and the internal conductor is reduced, the ceramic of which the dielectric block is made is broken when fired. It is therefore difficult to reduce the space between the terminal electrode and the internal conductor, too.

According to the dielectric filter disclosed in the Published Unexamined Japanese Patent Application 2000-349505, it is difficult to greatly change the area of the terminal electrode and the space between the terminal electrode and the internal conductor. It is therefore difficult to adjust the capacitance produced between the terminal electrode and the internal conductor in this dielectric filter.

As described so far, it is difficult to adjust the filter characteristics, according to the dielectric filter disclosed in the Published Unexamined Japanese Patent Application 2000-349505.

OBJECT AND SUMMARY OF THE INVENTION

It is an object of the invention to provide a multi-layer band-pass filter that is small-sized, capable of outputting balanced signals, and allows easy adjustment of its characteristics.

Each of first and second multi-layer band-pass filters of the invention comprises: an unbalanced input for receiving unbalanced signals; two balanced outputs for outputting balanced signals; a band-pass filter section provided between the unbalanced input and the balanced outputs and incorporating a plurality of resonators each of which is made up of a TEM line; and a multi-layer substrate used for integrating the resonators.

According to the first multi-layer band-pass filter of the invention, the band-pass filter section incorporates, as the resonators, an input resonator to which the unbalanced input is connected, and a half-wave resonator for balanced output to which the two balanced outputs are connected. The half-wave resonator for balanced output is made up of a half-wave resonator having open-circuited ends. The multi-layer band-pass filter further comprises a capacitor made up of part of the multi-layer substrate and provided in at least one of a location between the unbalanced input and the input resonator and a location between each of the balanced outputs and the half-wave resonator for balanced output.

In the first multi-layer band-pass filter of the invention, the two balanced outputs are connected to the half-wave resonator for balanced output that is made up of a half-wave resonator having open-circuited ends. It is thereby possible to output balanced signals from the two balanced outputs without providing any balun. In this multi-layer band-pass filter, the capacitor made up of part of the multi-layer substrate is provided in at least one of a location between the unbalanced input and the input resonator and a location between each of the balanced outputs and the half-wave resonator for balanced output. According to this multi-layer band-pass filter, it is easy to adjust the capacitance of the capacitor, and therefore it is easy to adjust the filter characteristics.

The first multi-layer band-pass filter of the invention may further comprise first and second output capacitors as the capacitor provided between the half-wave resonator for balanced output and the respective balanced outputs. In this case, one of the balanced outputs may be connected through the first output capacitor to an end of the length of the half-wave resonator for balanced output, and the other one of the balanced outputs may be connected through the second output capacitor to the other end of the length of the half-wave resonator for balanced output. In this case, the first output capacitor and the second output capacitor may have different capacitances.

In the first multi-layer band-pass filter of the invention, at least one of the resonators may have such a shape that the capacitance or inductance is greater compared with a case in which the resonator is rectangle-shaped.

In the first multi-layer band-pass filter of the invention, the band-pass filter section may incorporate at least one half-wave resonator having open-circuited ends, the open-circuited ends being connected to each other through a capacitor.

According to the second multi-layer band-pass filter of the invention, the band-pass filter section incorporates, as the resonators, a half-wave resonator for balanced output that is made up of a half-wave resonator having open-circuited ends, and quarter-wave resonators for balanced output each of which is made up of a quarter-wave resonator. The quarter-wave resonators for balanced output are provided to form one or more stages, each stage consisting of a pair of the quarter-wave resonators for balanced output. The quarter-wave resonators for balanced output are disposed between the half-wave resonator for balanced output and the balanced outputs. The balanced outputs are connected to a pair of the quarter-wave resonators for balanced output of a final stage, respectively. The multi-layer band-pass filter further comprises a capacitor made up of part of the multi-layer substrate and provided in at least one of a location between the unbalanced input and the resonator connected thereto and a location between each of the balanced outputs and the pair of the quarter-wave resonators of the final stage.

As described above, the second multi-layer band-pass filter of the invention comprises the half-wave resonator for balanced output that is made up of a half-wave resonator having open-circuited ends, and one or more stages of the quarter-wave resonators for balanced output disposed between the half-wave resonator for balanced output and the balanced outputs. The two balanced outputs are connected to the pair of the quarter-wave resonators for balanced output of the final stage, respectively. As a result, according to the second multi-layer band-pass filter, it is possible to output balanced signals from the two balanced outputs without providing any balun. In this multi-layer band-pass filter, the capacitor made up of part of the multi-layer substrate is provided in at least one of a location between the unbalanced input and the resonator connected thereto and a location between each of the balanced outputs and the pair of the quarter-wave resonators of the final stage. According to this multi-layer band-pass filter, it is easy to adjust the capacitance of the capacitor, and therefore it is easy to adjust the filter characteristics.

In the second multi-layer band-pass filter of the invention, the pair of the quarter-wave resonators of the final stage may be only provided as the quarter-wave resonators for balanced output. One of the pair of the quarter-wave resonators of the final stage may be coupled to one of half portions of the half-wave resonator for balanced output, and the other one of the pair of the quarter-wave resonators of the final stage may be coupled to the other one of the half portions of the half-wave resonator for balanced output, the half portions of the half-wave resonator for balanced output being taken along the length thereof.

The pair of the quarter-wave resonators of the final stage may be coupled to the half-wave resonator by means of a single coupling method. One of the pair of the quarter-wave resonators of the final stage may be coupled only to one of the half portions of the half-wave resonator, and the other one of the pair of the quarter-wave resonators of the final stage may be coupled only to the other one of the half portions of the half-wave resonator.

In the second multi-layer band-pass filter of the invention, a plurality of stages of the quarter-wave resonators for balanced output may be provided. In this case, one of a pair of the quarter-wave resonators of a first stage closest to the half-wave resonator for balanced output may be coupled to one of half portions of the half-wave resonator for balanced output, and the other one of the pair of the quarter-wave resonators of the first stage may be coupled to the other one of the half portions of the half-wave resonator for balanced output, the half portions of the half-wave resonator for balanced output being taken along the length thereof The pair of the quarter-wave resonators of the first stage may be coupled to the half-wave resonator by means of a single coupling method. One of the pair of the quarter-wave resonators of the first stage may be coupled only to one of the half portions of the half-wave resonator, and the other one of the pair of the quarter-wave resonators of the first stage may be coupled only to the other one of the half portions of the half-wave resonator. A pair of the quarter-wave resonators of each of the stages may be coupled to a pair of the quarter-wave resonators of a previous or next stage by means of a single coupling method.

In the second multi-layer band-pass filter of the invention, at least one of the resonators may have such a shape that the capacitance or inductance is greater compared with a case in which the resonator is rectangle-shaped.

In the second multi-layer band-pass filter of the invention, the band-pass filter section may incorporate at least one half-wave resonator having open-circuited ends, the open-circuited ends being connected to each other through a capacitor.

As described above, according to the first multi-layer band-pass filter of the invention, the band-pass filter section incorporates, as the resonators, the input resonator to which the unbalanced input is connected, and the half-wave resonator for balanced output to which the balanced outputs are connected. The half-wave resonator for balanced output is made up of a half-wave resonator having open-circuited ends. The multi-layer band-pass filter of the invention comprises the multi-layer substrate used for integrating the resonators. In the multi-layer band-pass filter, the capacitor made up of part of the multi-layer substrate is provided in at least one of a location between the unbalanced input and the input resonator and a location between each of the balanced outputs and the half-wave resonator for balanced output. Because of these features of the invention, it is possible to implement the multi-layer band-pass filter that is capable of producing balanced signals, small-sized, and easy to adjust the characteristics.

According to the second multi-layer band-pass filter of the invention, the band-pass filter section incorporates, as the resonators, the half-wave resonator for balanced output that is made up of a half-wave resonator having open-circuited ends, and the quarter-wave resonators for balanced output each of which is made up of a quarter-wave resonator. The quarter-wave resonators for balanced output are provided to form one or more stages, each stage consisting of a pair of the quarter-wave resonators for balanced output. The quarter-wave resonators for balanced output are disposed between the half-wave resonator for balanced output and the balanced outputs. The balanced outputs are connected to the pair of the quarter-wave resonators of the final stage, respectively. The multi-layer band-pass filter of the invention comprises the multi-layer substrate used for integrating the resonators. In the multi-layer band-pass filter, the capacitor made up of part of the multi-layer substrate is provided in at-least one of a location between the unbalanced input and the resonator connected thereto and a location between each of the balanced outputs and the pair of the quarter-wave resonators of the final stage. Because of these features of the invention, it is possible to implement the multi-layer band-pass filter that is capable of producing balanced signals, small-sized, and easy to adjust the characteristics.

Other and further objects, features and advantages of the invention will appear more fully from the following description.

DESCRIPTION OF PREFERRED EMBODIMENTS

Preferred embodiments of the invention will now be described in detail with reference to the accompanying drawings.

FIRST EMBODIMENT

Figure 1:
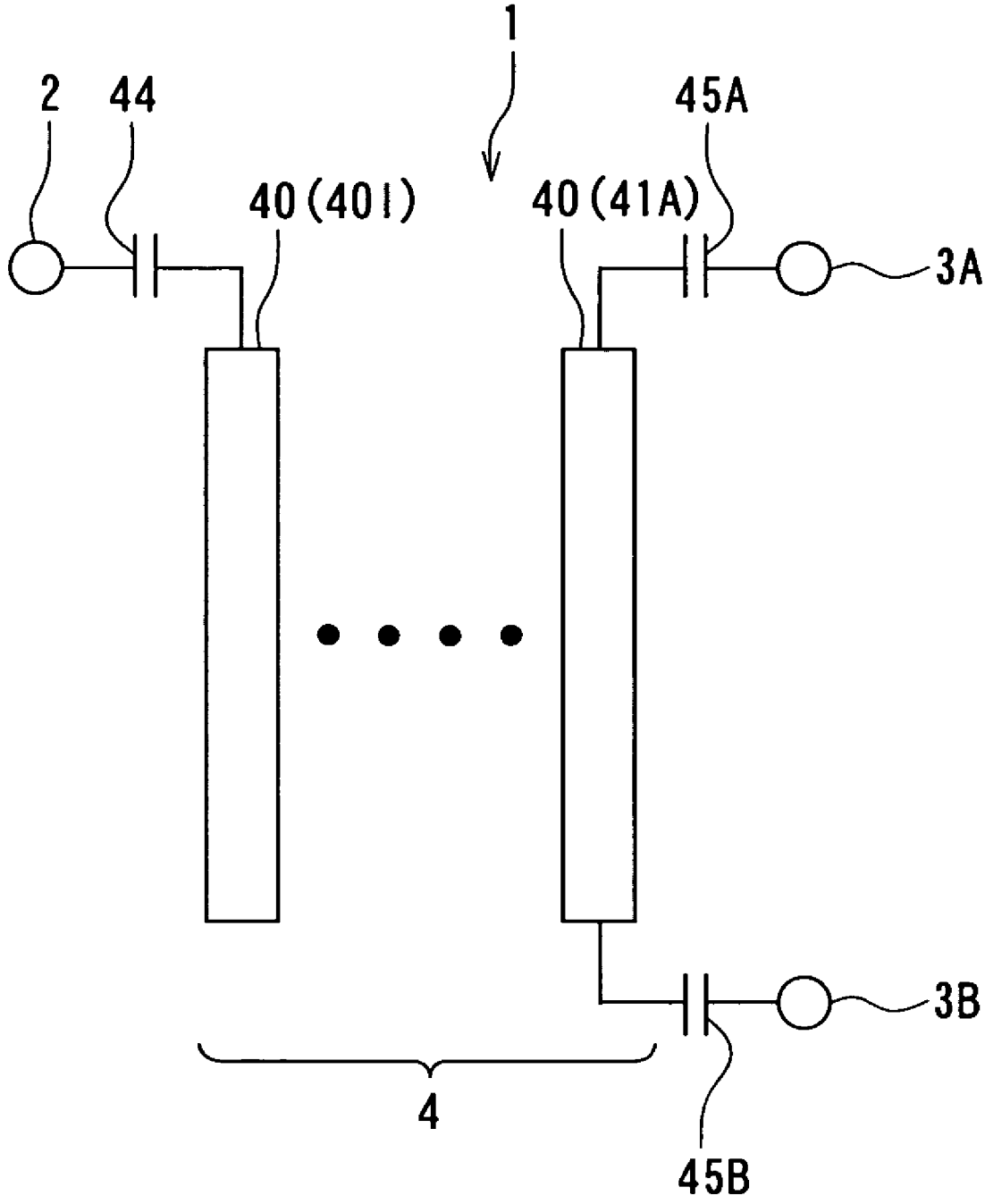
FIG. 1 illustrates a basic configuration of a multi-layer band-pass filter of a first embodiment of the invention.

Reference is now made to FIG. 1 to describe a basic configuration of a multi-layer band-pass filter of a first embodiment of the invention. As shown in FIG. 1, the multi-layer band-pass filter 1 of the embodiment comprises: a single unbalanced input 2 for receiving unbalanced signals; two balanced outputs 3A and 3B for outputting balanced signals; and a band-pass filter section 4 provided between the unbalanced input 2 and the balanced outputs 3A and 3B. The band-pass filter section 4 incorporates a plurality of resonators 40 each of which is made up of a TEM line. The multi-layer band-pass filter 1 further comprises a multi-layer substrate used for integrating the resonators 40.

The band-pass filter section 4 incorporates, as the resonators 40, an input resonator 40I to which the unbalanced input 2 is connected, and a half-wave resonator 41A for balanced output to which the balanced outputs 3A and 3B are connected. The half-wave resonator 41A for balanced output is made up of a half-wave resonator having open-circuited ends.

The multi-layer band-pass filter 1 further comprises a capacitor made up of part of the multi-layer substrate and provided in at least one of a location between the unbalanced input 2 and the input resonator 40I and a location between the half-wave resonator 41A and each of the balanced outputs 3A and 3B. FIG. 1 illustrates an example in which the band-pass filter 1 comprises: an input capacitor 44 provided in a location between the unbalanced input 2 and the input resonator 40I; a first output capacitor 45A provided in a location between the balanced output 3A and the half-wave resonator 41A; and a second output capacitor 45B provided in a location between the balanced output 3B and the half-wave resonator 41A. However, according to the embodiment, it is possible that only the capacitor 44 among the capacitors 44, 45A and 45B is provided and the balanced outputs 3A and 3B are directly connected to the half-wave resonator 41A. According to the embodiment, it is also possible that only the capacitors 45A and 45B among the capacitors 44, 45A and 45B are provided and the unbalanced input 2 is directly connected to the input resonator 401.

A TEM line is a transmission line for transmitting transverse electromagnetic waves (TEM waves) that are electromagnetic waves whose electric field and magnetic field exist only in cross sections orthogonal to the direction of travel of the electromagnetic waves.

The multi-layer substrate has a structure in which dielectric layers and patterned conductor layers are alternately stacked, which will be described in detail later. The resonators 40 and the capacitors 44, 45A and 45B are made up of the conductor layers of the multi-layer substrate. Each of the resonators 40 is a distributed-constant line.

The plurality of resonators 40 making up the band-pass filter section 4 have equal resonant frequencies. The resonators 40 are arranged such that adjacent ones are electromagnetically coupled to each other. As a result, the resonators 40 have a function of a band-pass filter for selectively allowing signals of frequencies within a specific frequency band to pass.

Each of the resonators 40 may be any of a half-wave resonator having open-circuited ends, a half-wave resonator having short-circuited ends, and a quarter-wave resonator.

Figure 2:
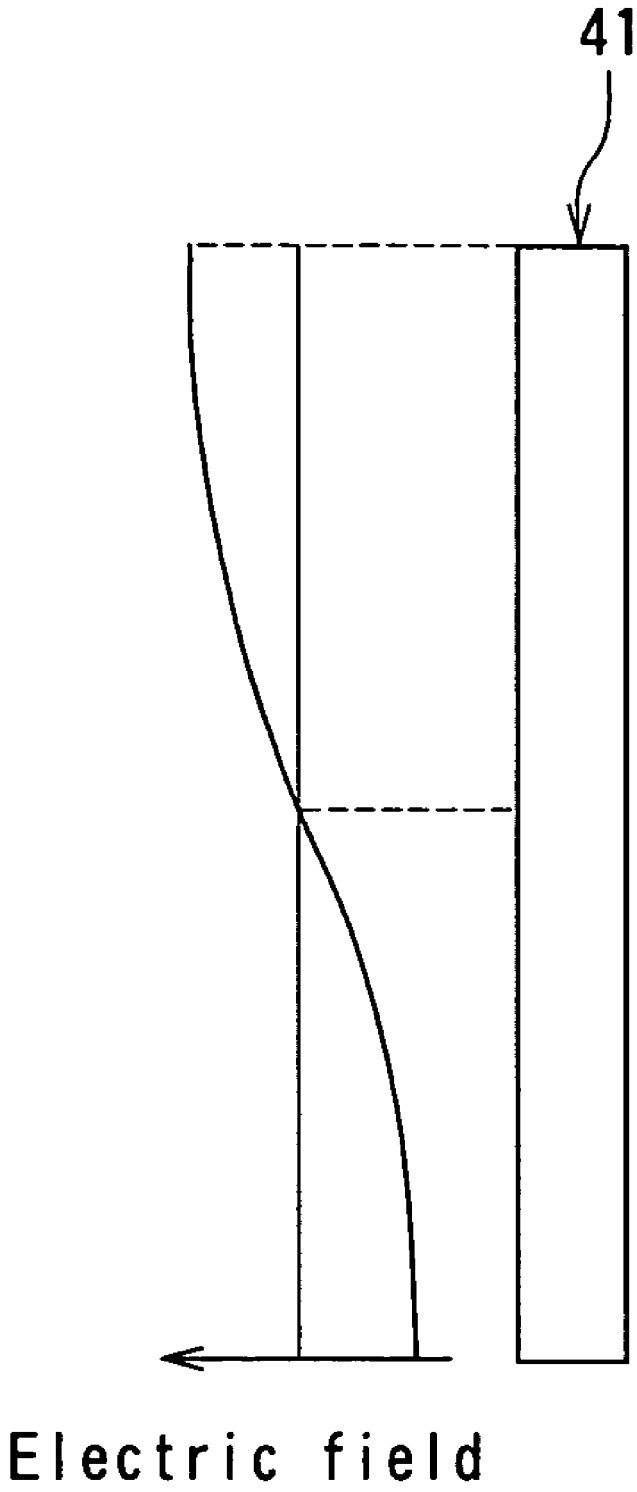
FIG. 2 illustrates a half-wave resonator having open-circuited ends.

FIG. 2 illustrates a half-wave resonator 41 having open-circuited ends and an electric field distribution of the resonator 41. As shown in FIG. 2, for the resonator 41, the electric field is zero in the middle along the direction of length, and the electric field is maximum at both ends. In one half of the resonator 41 taken along the length thereof, the phase of the electric field at any point is the same. Similarly, in the other half of the resonator 41, the phase of the electric field at any point is the same. The electric fields of the first half and the other half are 180 degrees out of phase with each other, and the positive and negative signs of the fields are opposite to each other.

Figure 3:
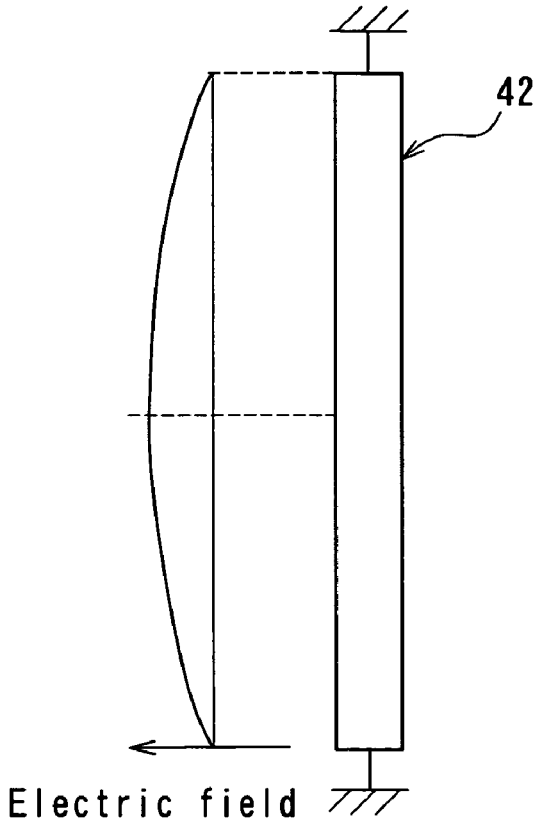
FIG. 3 illustrates a half-wave resonator having short-circuited ends.

FIG. 3 illustrates a half-wave resonator 42 having short-circuited ends and an electric field distribution of the resonator 42. As shown in FIG. 3, for the resonator 42, the electric field is maximum in the middle along the direction of length, and the electric field is zero at both ends.

Figure 4:
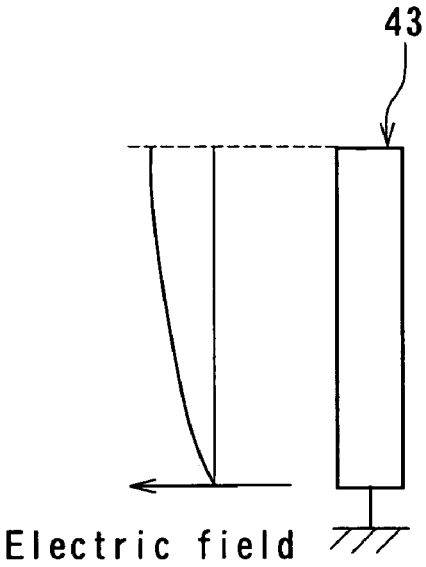
FIG. 4 illustrates a quarter-wave resonator.

FIG. 4 illustrates a quarter-wave resonator 43 and an electric field distribution of the resonator 43. As shown in FIG. 4, the resonator 43 has an end short-circuited and the other end open-circuited. For the resonator 43, the electric field is zero at the short-circuited end, and the electric field is maximum at the open-circuited end.

FIG. 1 shows an example in which the half-wave resonator 41 having the open-circuited ends shown in FIG. 2 is used as the input resonator 40I. In this example, the unbalanced input 2 is connected through the input capacitor 44 to one of ends of the length of the input resonator 40I. The balanced output 3A is connected through the first output capacitor 45A to one of ends of the length of the half-wave resonator 41A. The balanced output 3B is connected through the second output capacitor 45B to the other one of the ends of the length of the half-wave resonator 41A.

When the half-wave resonator 42 having the short-circuited ends shown in FIG. 3 is used as the input resonator 40I, the unbalanced input 2 is connected to the middle of the length of the resonator 42. When the quarter-wave resonator 43 of FIG. 4 is used as the input resonator 40I, the unbalanced input 2 is connected to the open-circuited end of the resonator 43.

Figure 5:
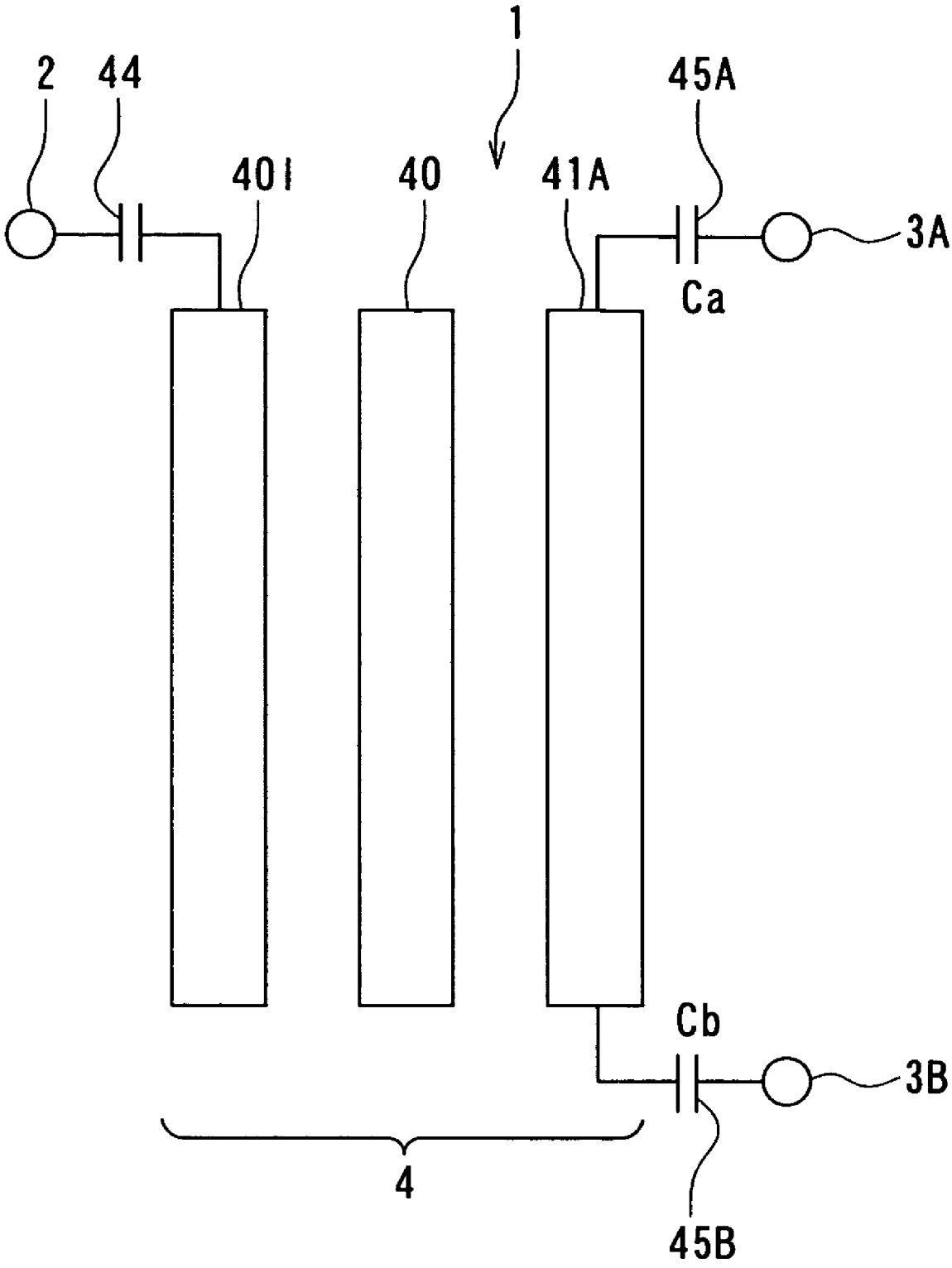
FIG. 5 is a diagram for explaining the operation of the multi-layer band-pass filter of the first embodiment.

Reference is now made to FIG. 5 to describe the operation of the multi-layer band-pass filter 1 of the embodiment. Unbalanced signals are inputted to the unbalanced input 2 of the band-pass filter 1. Among these signals, signals of frequencies within a specific frequency band are selectively allowed to pass through the band-pass filter section 4. The resonator 40 of the final stage of the band-pass filter section 4 is the half-wave resonator 41A for balanced output that is made up of the half-wave resonator 41 having the open-circuited ends. As described with reference to FIG. 2, one half portion and the other half portion of the resonator 41A taken along the length thereof have the electric fields 180 degrees out of phase with each other. The balanced output 3A is connected to one of the half portions of the resonator 41A while the balanced output 3B is connected to the other one of the half portions of the resonator 41A. As a result, the voltages outputted from the balanced outputs 3A and 3B are always 180 degrees out of phase with each other. Therefore, if the two voltages outputted from the balanced outputs 3A and 3B have equal amplitudes, it is possible that balanced signals are outputted from the balanced outputs 3A and 3B.

A method of making the two voltages outputted from the balanced outputs 3A and 3B have equal amplitudes will now be described. In FIG. 5, the capacitances of the capacitors 45A and 45B are denoted as Ca and Cb, respectively. If one half portion and the other half portion of the resonator 41A have symmetrical electric field distributions, making the capacitances Ca and Cb equal can make the two voltages outputted from the balanced outputs 3A and 3B have equal amplitudes. However, there are some cases in which one half portion and the other half portion of the resonator 41A do not have symmetrical electric field distributions because of reasons such as the fact that the unbalanced input 2 is connected to the input resonator 40I. In this case, it is possible to make the amplitudes of the two voltages outputted from the balanced outputs 3A and 3B equal to each other by making the capacitances Ca and Cb of the capacitors 45A and 45B different from each other. This is because, as stated in the foregoing description of the external Q, the intensity of coupling of the balanced outputs 3A and 3B to the resonator 41A is varied according to the values of the capacitances Ca and Cb.

The capacitors 44, 45A and 45B are designed to have appropriate capacitance values, according to the filter characteristics, that is, the center frequency, the band width, the number of stages, magnitude of ripples, and so on.

Figure 6:
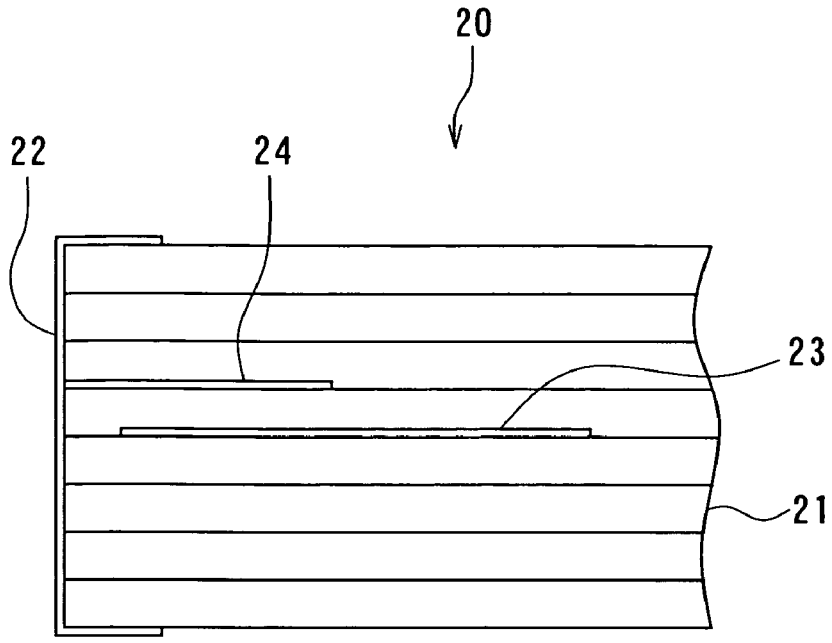
FIG. 6 illustrates an example of the structure of a capacitor made up of conductor layers of the multi-layer substrate of the first embodiment.
Figure 7:
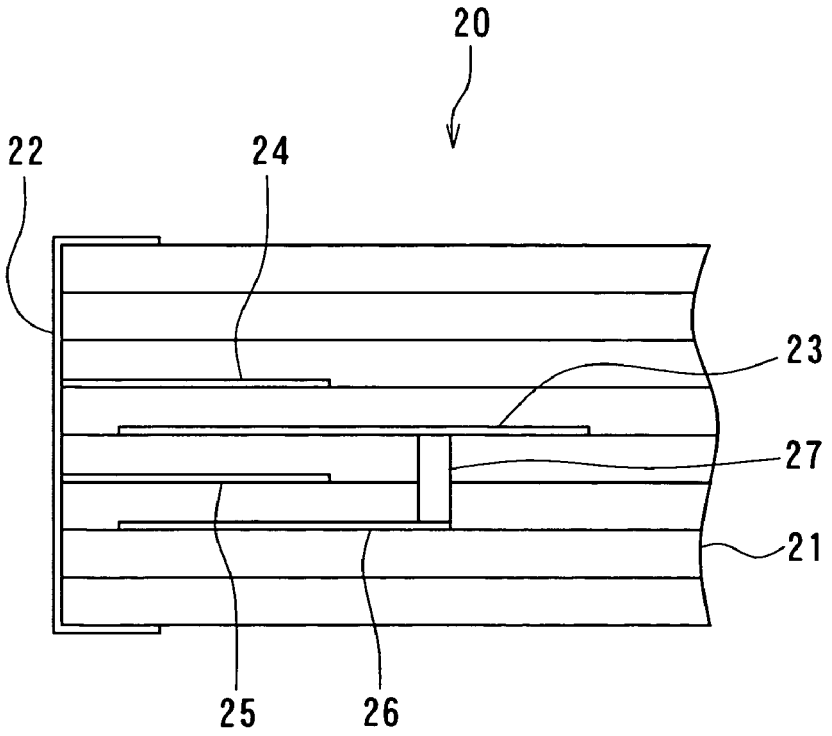
FIG. 7 illustrates an example of the structure of a capacitor made up of conductor layers of the multi-layer substrate of the first embodiment.

Reference is now made to FIG. 6 and FIG. 7 to describe a method of forming the capacitors 44, 45A and 45B. The capacitors 44, 45A and 45B are made up of the conductor layers of a multi-layer substrate. FIG. 6 illustrates an example of the structure of the capacitor made up of the conductor layers of the multi-layer substrate. The multi-layer substrate 20 of FIG. 6 has a structure in which dielectric layers 21 and the patterned conductor layers are alternately stacked. A plurality of terminal electrodes 22 are formed on the top surface, the bottom surface and the side surfaces of the multi-layer substrate 20. The multi-layer substrate 20 of FIG. 6 incorporates a single resonator 23 made up of the conductor layer, and a conductor layer 24 for capacitor opposed to the resonator 23. The conductor layer 24 is connected to the terminal electrodes 22. In the multi-layer substrate 20, the resonator 23 and the conductor layer 24 make up the capacitor connected to the resonator 23.

FIG. 7 illustrates another example of the structure of the capacitor made up of the conductor layers of the multi-layer substrate. Like the multi-layer substrate 20 of FIG. 6, the multi-layer substrate 20 of FIG. 7 has a structure in which the dielectric layers 21 and the patterned conductor layers are alternately stacked. A plurality of terminal electrodes 22 are formed on the top surface, the bottom surface and the side surfaces of the multi-layer substrate 20. The multi-layer substrate 20 of FIG. 7 incorporates the single resonator 23 made up of the conductor layer, two conductor layers 24 and 25 for capacitors disposed to sandwich the resonator 23, and a conductor layer 26 for capacitors located opposite to the resonator 23, with the conductor layer 25 disposed between the conductor layer 26 and the resonator 23. The conductor layer 26 is connected to the resonator 23 via a through hole 27. The conductor layers 24 and 25 are connected to the terminal electrodes 22. In the multi-layer substrate 20, the capacitor connected to the resonator 23 is made up of the resonator 23, the conductor layer 26, and the conductor layers 24 and 25 opposed to the resonator 23 and the conductor layer 26.

If the capacitor is made up of the conductor layers of the multi-layer substrate as thus described, it is possible to reduce the space between the opposed conductor layers. This facilitates formation of the capacitor having a high capacitance. In addition, the capacitance is readily changed by changing the areas of the conductor layers making up the capacitor. Furthermore, as shown in FIG. 7, making the capacitor by using the three or more conductor layers makes it easy to form the capacitor having a higher capacitance, compared with the case in which the capacitor is made up of two conductor layers.

First to fourth examples of specific configuration of the multi-layer band-pass filter 1 of the embodiment will now be described.

FIRST CONFIGURATION EXAMPLE

Figure 8:
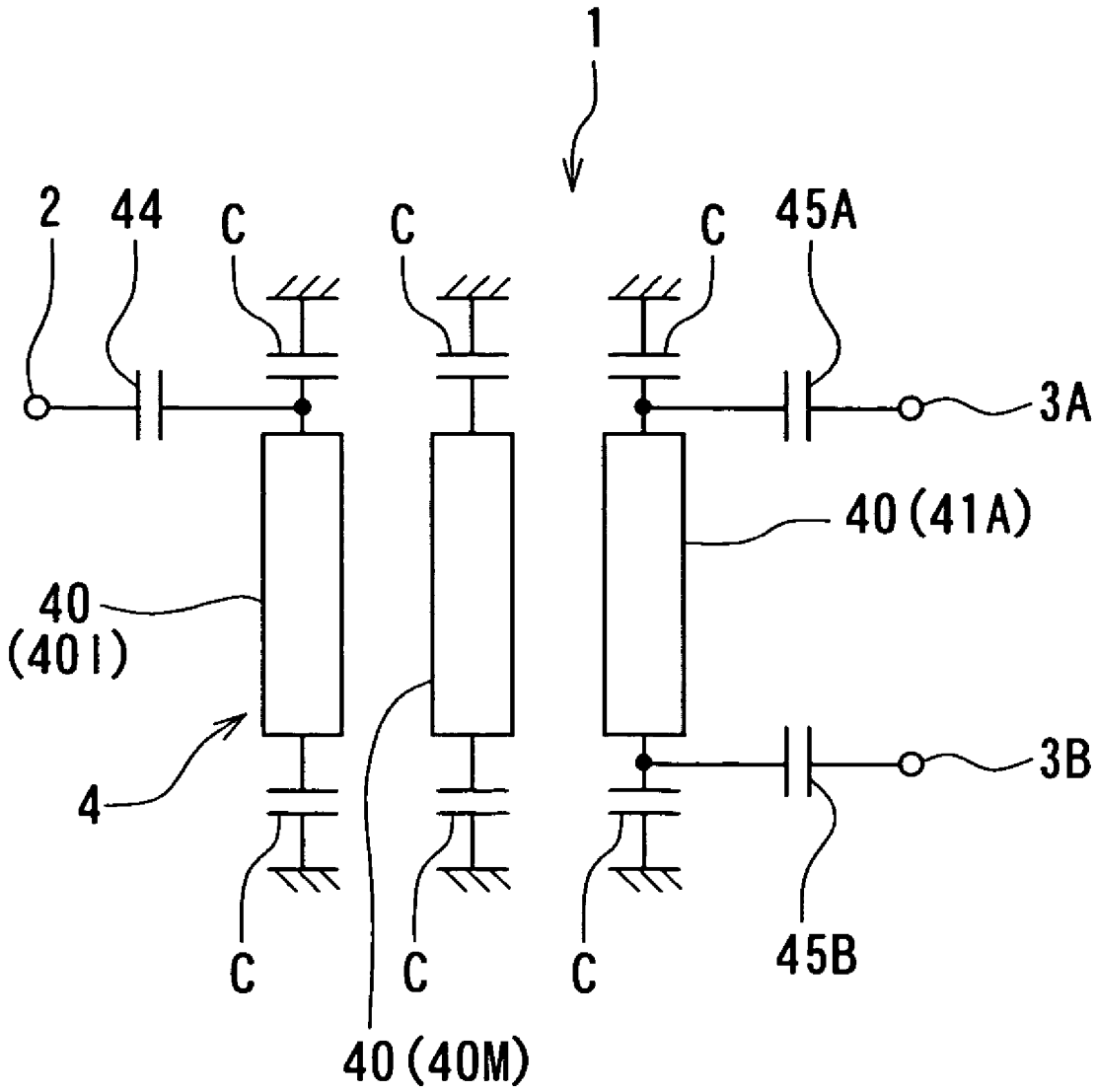
FIG. 8 is a schematic diagram of a multi-layer band-pass filter of a first configuration example of the first embodiment.

FIG. 8 is a schematic diagram of the multi-layer band-pass filter 1 of the first configuration example. The band-pass filter 1 comprises the unbalanced input 2, the balanced outputs 3A and 3B, and the band-pass filter section 4 provided between the unbalanced input 2 and the balanced outputs 3A and 3B. The band-pass filter section 4 incorporates three resonators 40 disposed side by side, each of which is made up of the resonator 41 having the open-circuited ends. Among the three resonators 40, the resonator 40 disposed closest to the unbalanced input 2 is the input resonator 40I. The unbalanced input 2 is connected to the input resonator 40I through the capacitor 44. The resonator 40 disposed closest to the balanced outputs 3A and 3B is the half-wave resonator 41A. The balanced outputs 3A and 3B are connected to the half-wave resonator 41A through the capacitors 45A and 45B, respectively. The resonator 40 disposed between the resonator 40I and the resonator 41A will be hereinafter called a middle resonator 40M. The input resonator 40I and the middle resonator 40M are electromagnetically coupled to each other. The middle resonator 40M and the half-wave resonator 41A are electromagnetically coupled to each other, too. A capacitor C is provided between each of the open-circuited ends of each of the three resonators 40 and the ground.

Figure 9:
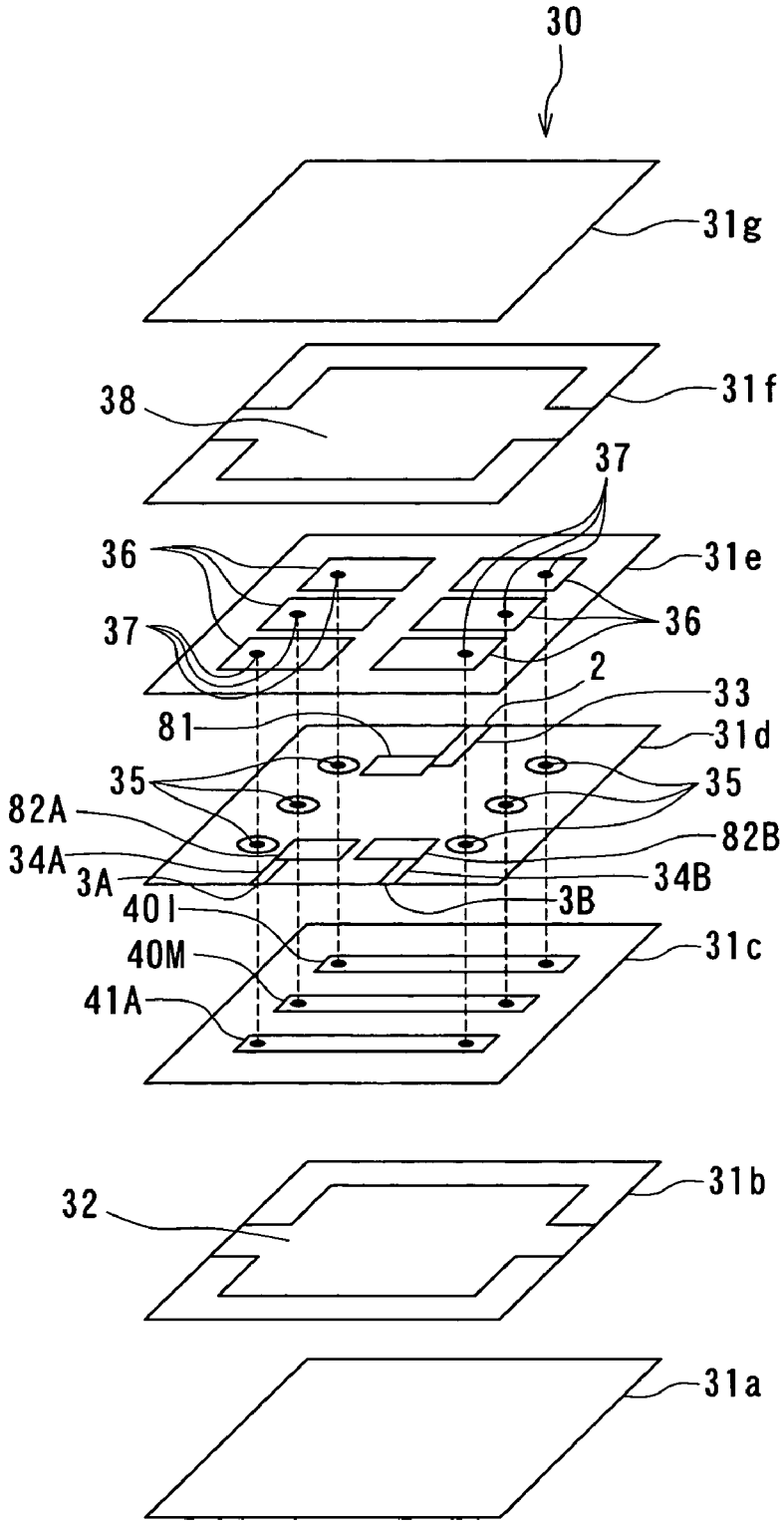
FIG. 9 is an exploded perspective view illustrating an example of configuration of a multi-layer substrate for implementing the multi-layer band-pass filter of FIG. 8.

FIG. 9 is an exploded perspective view illustrating an example of configuration of a multi-layer substrate 30 for implementing the multi-layer band-pass filter 1 of FIG. 8. In this example, the multi-layer substrate 30 incorporates seven dielectric layers 31*a* to 31*g* stacked from bottom to top. A conductor layer 32 for ground which also functions as a shield is formed on the top surface of the dielectric layer 31*b*. The input resonator 40I, the middle resonator 40M and the half-wave resonator 41A are formed on the top surface of the dielectric layer 31*c*.

On the top surface of the dielectric layer 31*d*, there are conductor layers 81, 82A and 82B for capacitors and conductor layers 33, 34A and 34B for terminals that are connected to the conductor layers 81, 82A and 82B, respectively. An end of the conductor layer 33 opposite to the conductor layer 81 is the unbalanced input 2. Ends of the conductor layers 34A and 34B opposite to the conductor layers 82A and 82B are the balanced outputs 3A and 3B, respectively. Six through holes 35 are formed in the locations of the top surface of the dielectric layer 31*d* corresponding to the ends of the resonators 40I, 40M and 41A.

Six conductor layers 36 for capacitors and six through holes 37 connected to the conductor layers 36 are formed in the locations of the top surface of the dielectric layer 31*e* corresponding to the six through holes 35. The conductor layers 36 are connected via the through holes 35 and 37 to the ends of the resonators 40I, 40M and 41A, respectively. The conductor layer 81 formed on the top surface of the dielectric layer 31*d* is opposed to one of the conductor layers 36 connected to one of the ends of the resonator 40I. These opposed conductor layers 81 and 36 make up the capacitor 44 of FIG. 8. The conductor layer 82A formed on the top surface of the dielectric layer 31*d* is opposed to another one of the conductor layers 36 connected to one of the ends of the resonator 41A. These opposed conductor layers 82A and 36 make up the capacitor 45A of FIG. 8. The conductor layer 82B formed on the top surface of the dielectric layer 31*d* is opposed to another one of the conductor layers 36 connected to the other of the ends of the resonator 41A. These opposed conductor layers 82B and 36 make up the capacitor 45B of FIG. 8.

A conductor layer 38 for ground which also functions as a shield is formed on the top surface of the dielectric layer 31*f*. The capacitors C of FIG. 8 are made up of the conductor layers 36 and the conductor layer 38.

Figure 10:
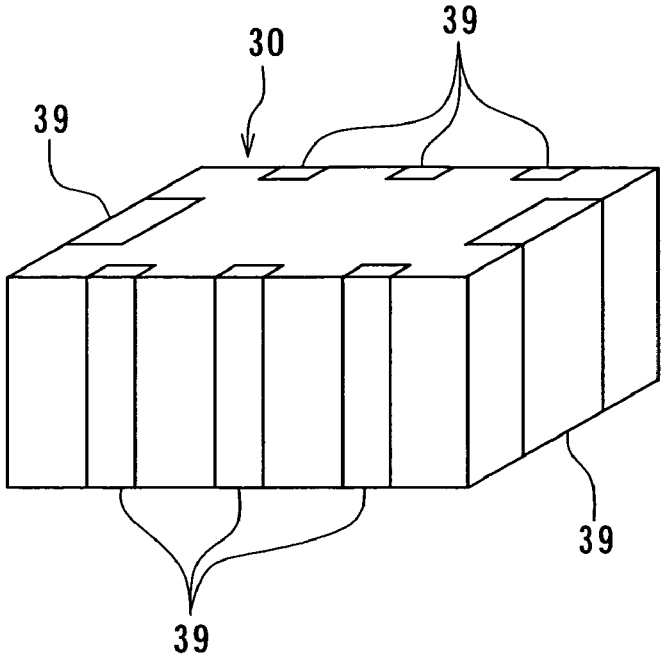
FIG. 10 is a perspective view illustrating an example of the appearance of the multi-layer substrate of FIG. 9.

FIG. 10 is a perspective view illustrating an example of the appearance of the multi-layer substrate 30 of FIG. 9. In this example a plurality of terminal electrodes 39 are formed on the top, bottom and side surfaces of the multi-layer substrate 30. The terminal electrodes 39 are connected to the conductor layers inside the multi-layer substrate 30 and used for connecting the conductor layers to external devices.

The multi-layer substrate 30 may be a multi-layer substrate of low-temperature co-fired ceramic, for example. In this case, the multi-layer substrate 30 may be fabricated through the following method. First, a ceramic green sheet having holes to be used as the through holes is provided. On this sheet a conductor layer having a specific pattern is formed, using a conductive paste whose main ingredient is silver, for example. Next, a plurality of ceramic green sheets having such conductor layers are stacked and these are fired at the same time. The through holes are thereby formed at the same time, too. Next, the terminal electrodes 39 are formed so that the multi-layer substrate 30 is completed.

According to the multi-layer band-pass filter 1 of the first configuration example, the band-pass filter section 4 is made up of the three resonators 40 arranged side by side, each of which is made up of the half-wave resonator 41 having the open-circuited ends. As a result, a good balance of balanced signals is achieved. In addition, the capacitor C is provided between each of the open-circuited ends of each of the resonators 40 and the ground. As a result, it is possible that the physical length of each of the resonators 40 having a desired resonant frequency is smaller, compared with the case in which the capacitors C are not provided.

SECOND CONFIGURATION EXAMPLE

Figure 11:
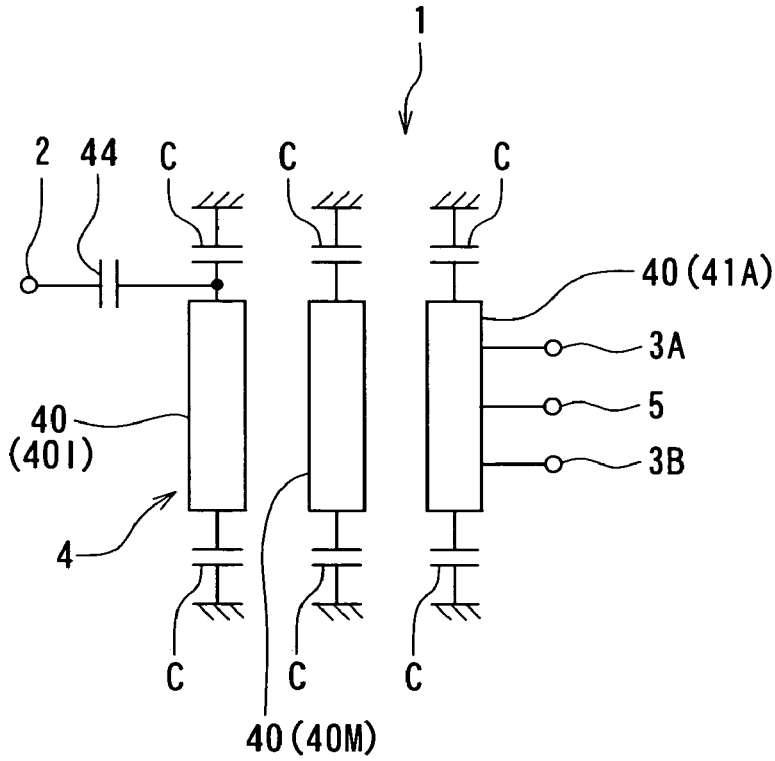
FIG. 11 is a schematic diagram of a multi-layer band-pass filter of a second configuration example of the first embodiment.

FIG. 11 is a schematic diagram of the multi-layer band-pass filter 1 of the second configuration example. According to this band-pass filter 1, a direct current voltage application terminal 5 is added to the band-pass filter 1 of the first configuration example of FIG. 8. The direct current voltage application terminal 5 is directly connected to a portion of the half-wave resonator 41A for balanced output near the middle of the length of the half-wave resonator 41A. In the second example, the balanced output 3A is directly connected to one half portion of the half-wave resonator 41A taken along the length thereof The balanced output 3B is directly connected to the other half portion of the half-wave resonator 41A taken along the length thereof. The terminal 5 is used to apply a direct current voltage to the resonator 41A. This direct current voltage is used to drive integrated circuits connected to the balanced outputs 3A and 3B, for example.

Figure 12:
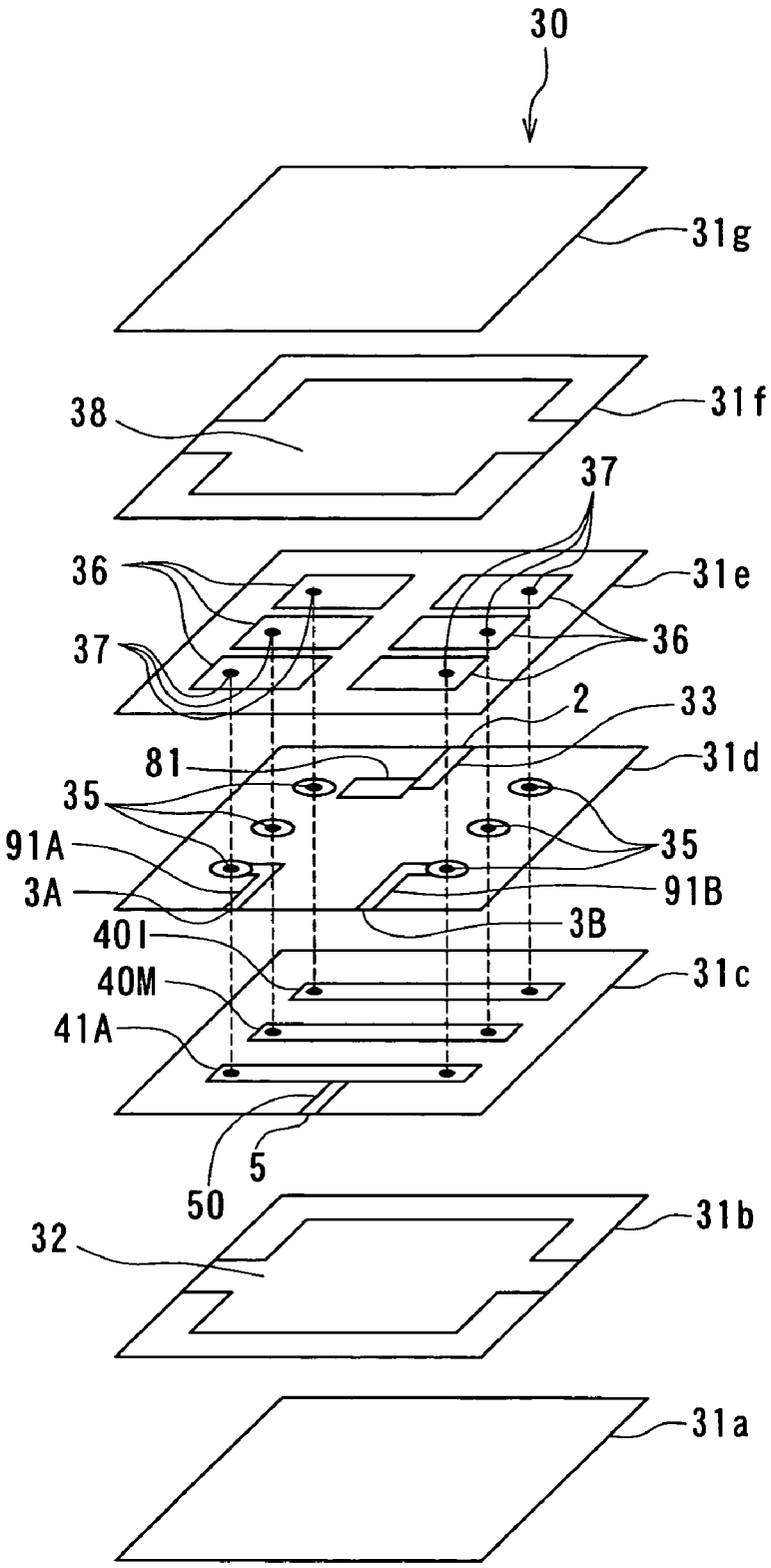
FIG. 12 is an exploded perspective view illustrating an example of configuration of a multi-layer substrate for implementing the multi-layer band-pass filter of FIG. 11.

FIG. 12 is an exploded perspective view illustrating an example of configuration of the multi-layer substrate 30 for implementing the multi-layer band-pass filter 1 of FIG. 11. In this example, a conductor layer 50 for a terminal connected to the half-wave resonator 41A is formed on the top surface of the dielectric layer 31*c* of the multi-layer substrate 30 of FIG. 9. An end of the conductor layer 50 opposite to the resonator 41A is the direct current voltage application terminal 5. In this example, conductor layers 91A and 91B for terminals are formed on the top surface of the dielectric layer 31*d* of the multi-layer substrate 30 of FIG. 9 in place of the conductor layers 82A and 82B and the conductor layers 34A and 34B. An end of each of the conductor layers 91A and 91B is connected to each of the through holes 35 connected to each end of the half-wave resonator 41A. The other ends of the conductor layers 91A and 91B are the balanced outputs 3A and 3B, respectively.

The remainder of configuration of the band-pass filter 1 of the second configuration example is similar to that of the band-pass filter 1 of the first configuration example.

THIRD CONFIGURATION EXAMPLE

Figure 13:
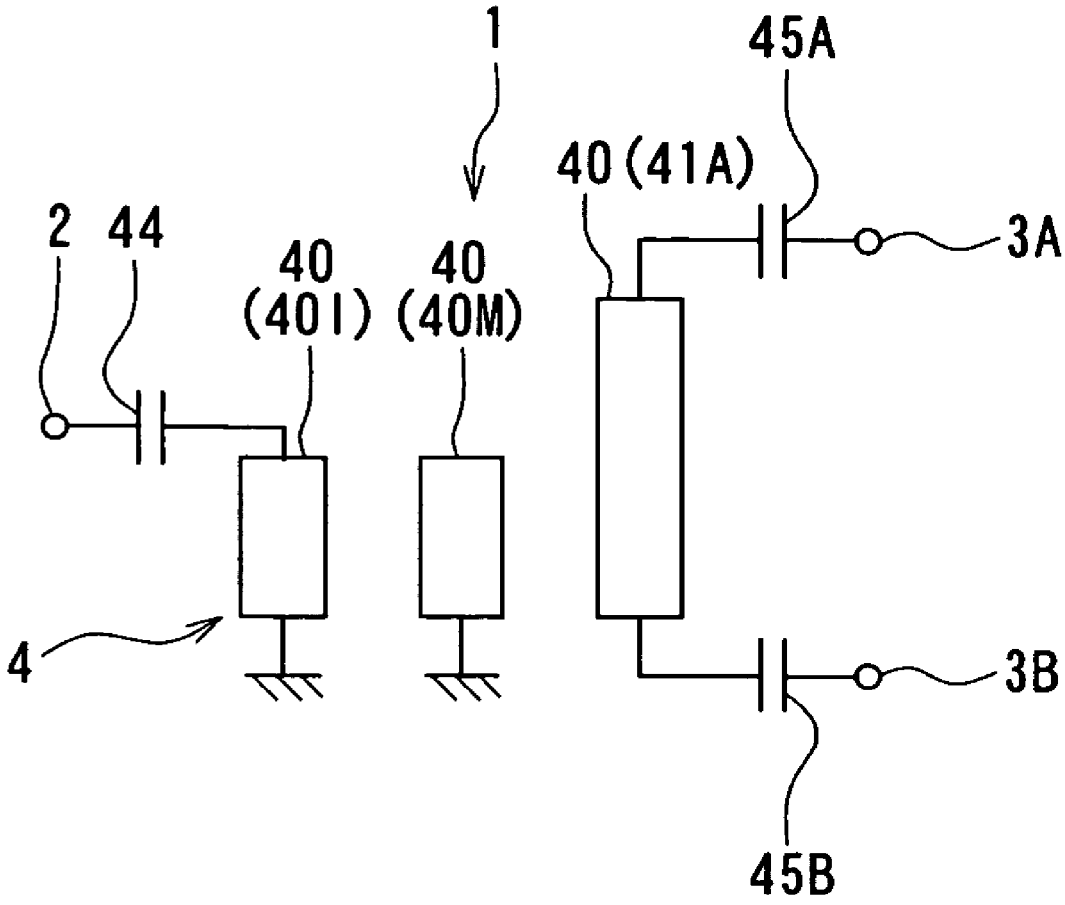
FIG. 13 is a schematic diagram of a multi-layer band-pass filter of a third configuration example of the first embodiment.

FIG. 13 is a schematic diagram of the multi-layer band-pass filter 1 of the third configuration example. The band-pass filter 1 comprises the unbalanced input 2, the balanced outputs 3A and 3B, and the band-pass filter section 4 provided between the unbalanced input 2 and the balanced outputs 3A and 3B. The band-pass filter section 4 incorporates the three resonators 40 disposed side by side. Among the three resonators 40, the resonator 40 disposed closest to the unbalanced input 2 is the input resonator 40I. The unbalanced input 2 is connected to the input resonator 40I through the capacitor 44. The resonator 40 disposed closest to the balanced outputs 3A and 3B is the half-wave resonator 41A for balanced output. The balanced outputs 3A and 3B are connected to the half-wave resonator 41A through the capacitors 45A and 45B, respectively. Each of the input resonator 40I and the middle resonator 40M is made up of the quarter-wave resonator 43. The input resonator 40I and the middle resonator 40M are electromagnetically coupled to each other. The middle resonator 40M and the half-wave resonator 41A are electromagnetically coupled to each other, too.

Figure 14:
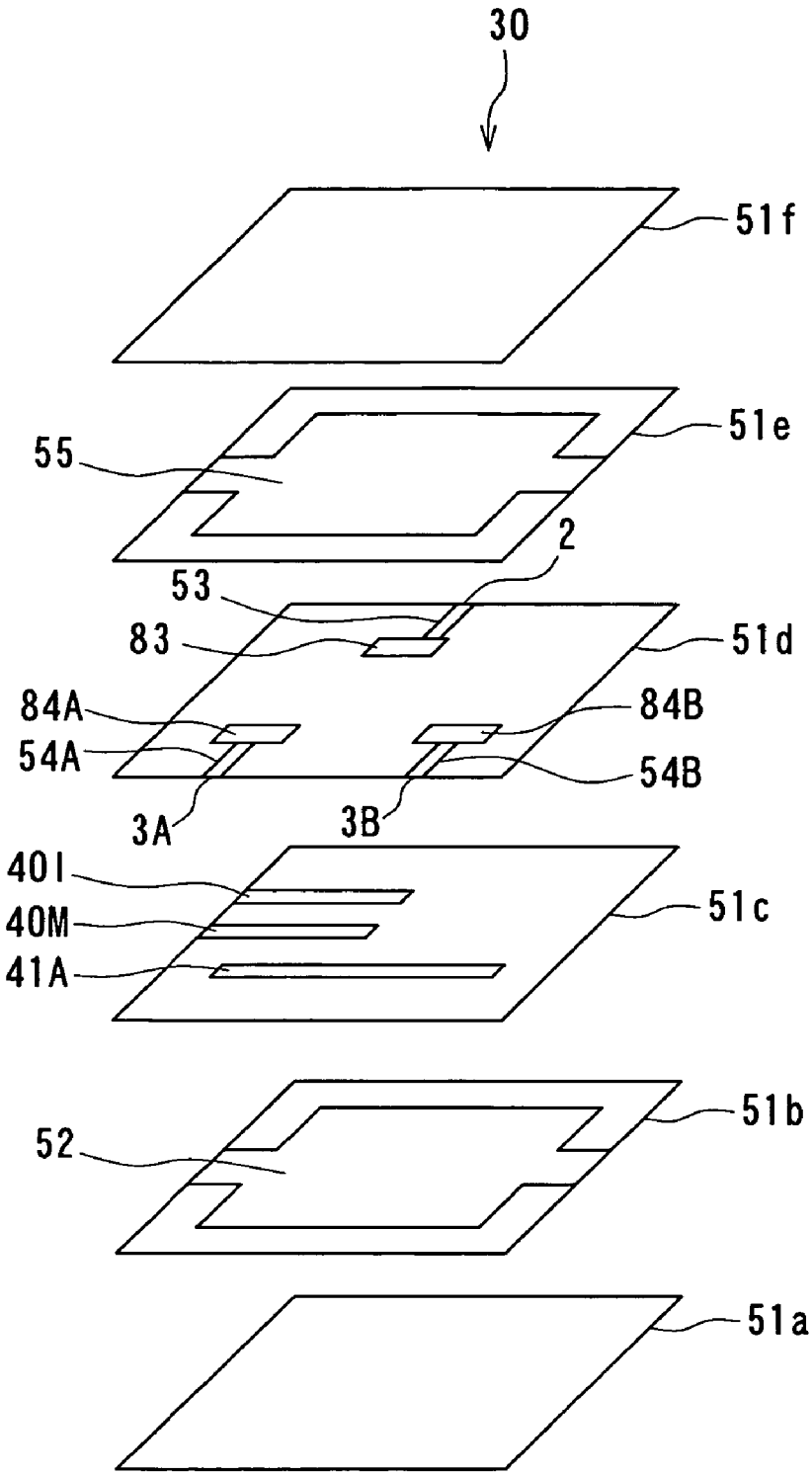
FIG. 14 is an exploded perspective view illustrating an example of configuration of a multi-layer substrate for implementing the multi-layer band-pass filter of FIG. 13.

FIG. 14 is an exploded perspective view illustrating an example of configuration of the multi-layer substrate 30 for implementing the multi-layer band-pass filter 1 of FIG. 13. In this example, the multi-layer substrate 30 incorporates six dielectric layers 51*a* to 51*f* stacked from bottom to top. A conductor layer 52 for ground which also functions as a shield is formed on the top surface of the dielectric layer 51*b*. The input resonator 40I, the middle resonator 40M and the half-wave resonator 41A are formed on the top surface of the dielectric layer 51*c*. On the top surface of the dielectric layer 51*d*, there are conductor layers 83, 84A and 84B for capacitors and conductor layers 53, 54A and 54B for terminals. The conductor layers 53, 54A and 54B are connected to the conductor layers 83, 84A and 84B, respectively. An end of the conductor layer 53 opposite to the conductor layer 83 is the unbalanced input 2. Ends of the conductor layers 54A and 54B opposite to the conductor layers 84A and 84B are the balanced outputs 3A and 3B, respectively. The conductor layer 83 faces toward a portion near an end of the input resonator 40I. These components make up the capacitor 44 of FIG. 13. The conductor layer 84A faces toward a portion near an end of the half-wave resonator 41A. These components make up the capacitor 45A of FIG. 13. The conductor layer 84B faces toward a portion near the other end of the half-wave resonator 41A. These components make up the capacitor 45B of FIG. 13. A conductor layer 55 for ground which also functions as a shield is formed on the top surface of the dielectric layer 51*e*.

The multi-layer substrate 30 of the third configuration example may have an appearance similar to that of the multi-layer substrate 30 of the first configuration example. According to the third configuration example, each of the input resonator 40I and the middle resonator 40M is made up of the quarter-wave resonator 43, so that the band-pass filter 1 is made smaller compared with the first configuration example.

FOURTH CONFIGURATION EXAMPLE

Figure 15:
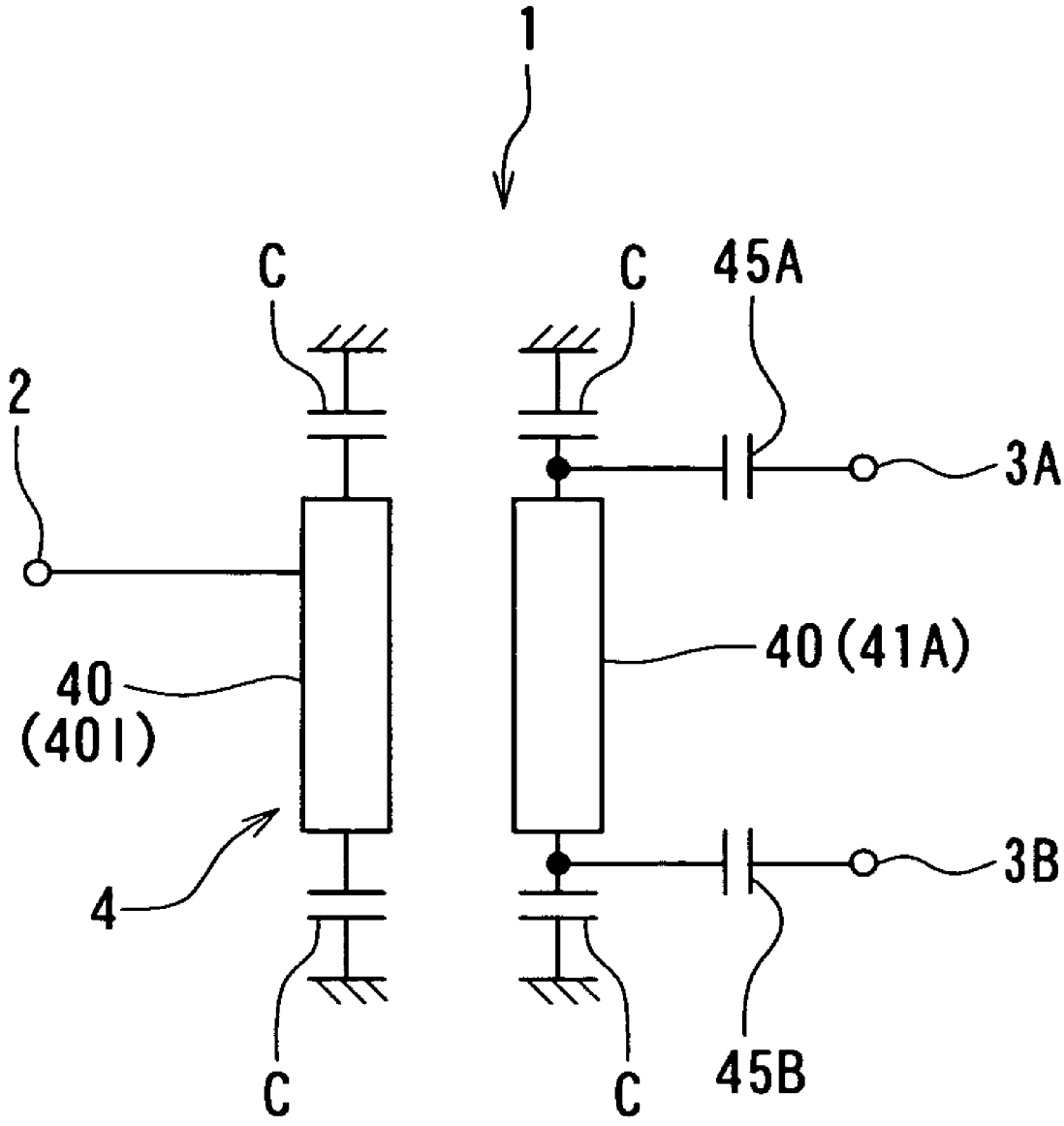
FIG. 15 is a schematic diagram of a multi-layer band-pass filter of a fourth configuration example of the first embodiment.

FIG. 15 is a schematic diagram of the multi-layer band-pass filter 1 of the fourth configuration example. The band-pass filter 1 comprises the unbalanced input 2, the balanced outputs 3A and 3B, and the band-pass filter section 4 provided between the unbalanced input 2 and the balanced outputs 3A and 3B. The band-pass filter section 4 incorporates two resonators 40 disposed side by side, each of which is made up of the resonator 41 having the open-circuited ends. One of the resonators 40 disposed closer to the unbalanced input 2 is the input resonator 40I. The unbalanced input 2 is directly connected to the input resonator 40I. The other of the resonators 40 disposed closer to the balanced outputs 3A and 3B is the half-wave resonator 41A for balanced output. The balanced outputs 3A and 3B are connected to the half-wave resonator 41A through the capacitors 45A and 45B, respectively. The input resonator 40I and the half-wave resonator 41A are electromagnetically coupled to each other. A capacitor C is provided between each of the open-circuited ends of each of the two resonators 40 and the ground.

Figure 16:
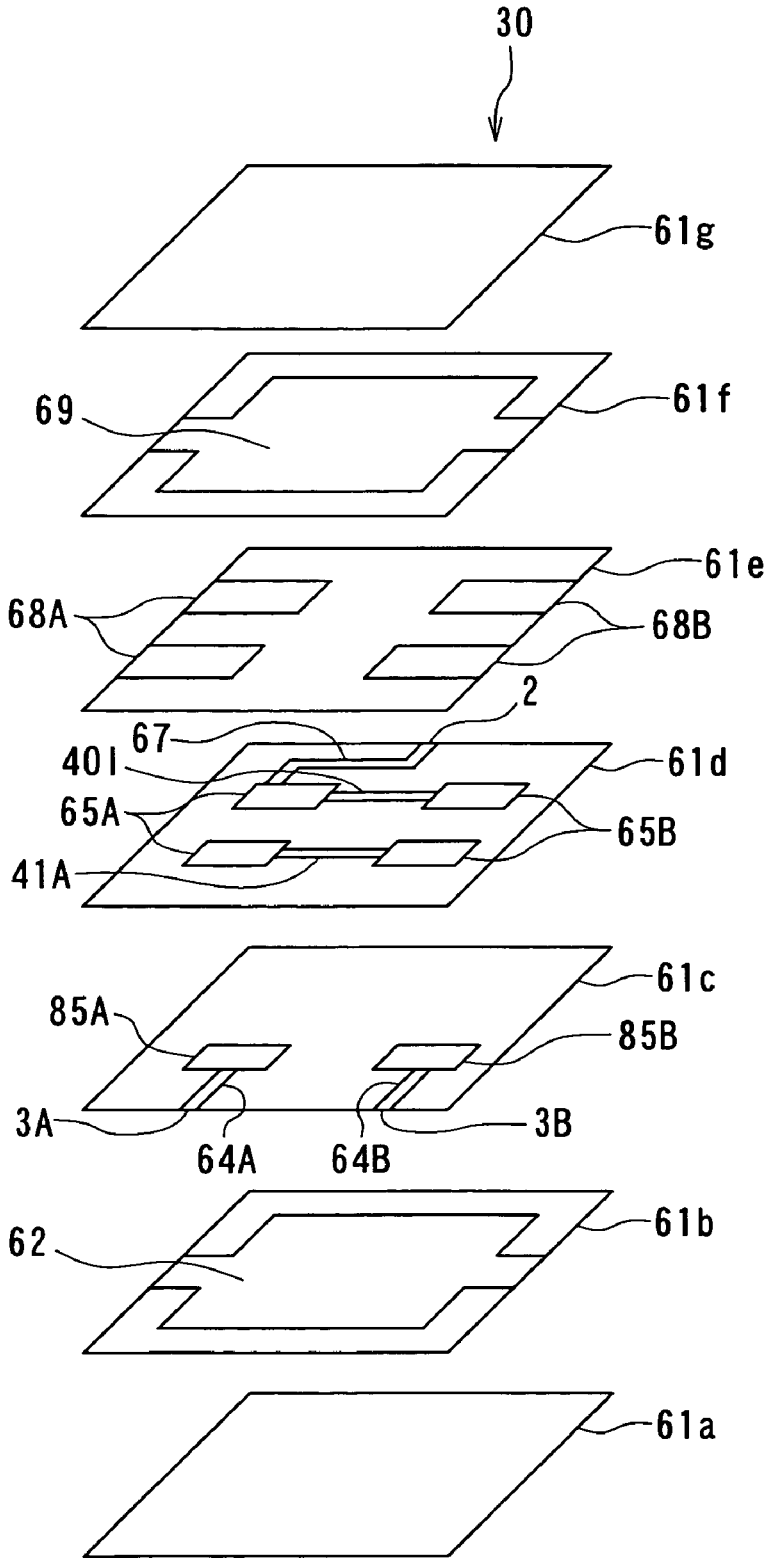
FIG. 16 is an exploded perspective view illustrating an example of configuration of a multi-layer substrate for implementing the multi-layer band-pass filter of FIG. 15.

FIG. 16 is an exploded perspective view illustrating an example of configuration of the multi-layer substrate 30 for implementing the multi-layer band-pass filter 1 of FIG. 15. In this example, the multi-layer substrate 30 incorporates seven dielectric layers 61*a* to 61*g* stacked from bottom to top. A conductor layer 62 for ground which also functions as a shield is formed on the top surface of the dielectric layer 61*b*. On the top surface of the dielectric layer 61*c*, there are conductor layers 85A and 85B for capacitors and conductor layers 64A and 64B for terminals. The conductor layers 64A and 64B are connected to the conductor layers 85A and 85B, respectively. Ends of the conductor layers 64A and 64B opposite to the conductor layers 85A and 85B are the balanced outputs 3A and 3B, respectively.

The input resonator 40I and the half-wave resonator 41A are formed on the top surface of the dielectric layer 61*d*. Furthermore, on the top surface of the dielectric layer 61*d*, there are two conductor layers 65A for capacitors that are connected to the respective ones of the ends of the resonators 40I and 41A, and two conductor layers 65B for capacitors that are connected to the respective other ends of the resonators 40I and 41A. The conductor layer 65A connected to the one of the ends of the resonator 41A faces toward the conductor layer 85A. The conductor layer 65B connected to the other one of the ends of the resonator 41A faces toward the conductor layer 85B. Furthermore, on the top surface of the dielectric layer 61*d*, there is a conductor layer 67 for a terminal that is connected the conductor layer 65A connected to the one of the ends of the input resonator 40I. An end of the conductor layer 67 opposite to the conductor layer 65A is the unbalanced input 2.

Two conductor layers 68A for ground and two conductor layers 68B for ground are formed on the top surface of the dielectric layer 61*e*. The two conductor layers 68A are disposed to face toward the two conductor layers 65A. Similarly, the two conductor layers 68B are disposed to face toward the two conductor layers 65B. A conductor layer 69 for ground which also functions as a shield is formed on the top surface of the dielectric layer 61*f*.

The capacitors C of FIG. 15 are made up of the conductor layers 65A and 65B and the conductor layers 68A and 68B. The capacitor 45A of FIG. 15 is made up of the conductor layer 85A and the conductor layer 65A opposed thereto. The capacitor 45B of FIG. 15 is made up of the conductor layer 85B and the conductor layer 65B opposed thereto.

The multi-layer substrate 30 of the fourth configuration example may have an appearance similar to that of the multi-layer substrate 30 of the first configuration example. According to the fourth configuration example, the capacitor C is provided between each of the open-circuited ends of each of the resonators 40 and the ground. As a result, it is possible that the physical length of each of the resonators 40 having a desired resonant frequency is smaller compared with the case in which the capacitors C are not provided. According to the fourth configuration example, the band-pass filter section 4 is made up of the two resonators 40. As a result, the insertion loss is smaller compared with the case in which the band-pass filter section 4 is made up of three resonators 40.

Figure 17:
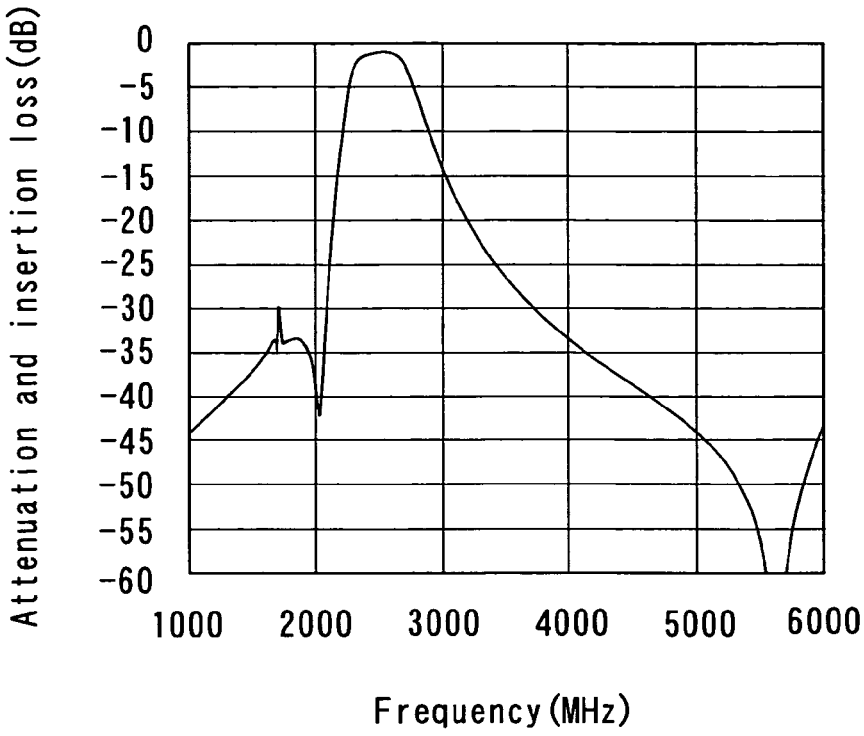
FIG. 17 is a plot showing the attenuation and insertion loss characteristics of the multi-layer band-pass filter of FIG. 8.
Figure 18:
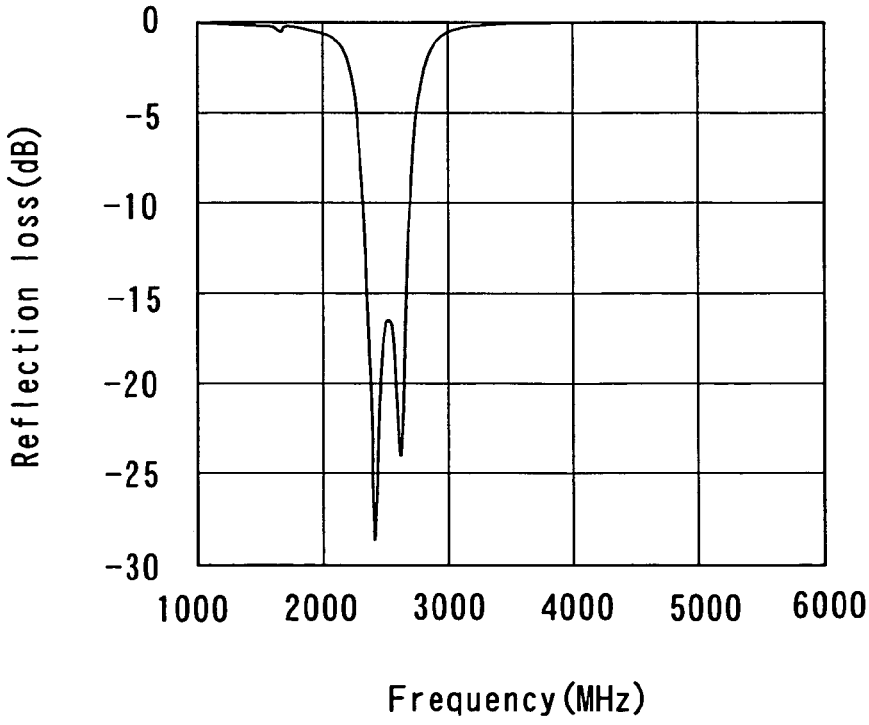
FIG. 18 is a plot showing the reflection loss characteristic of the multi-layer band-pass filter of FIG. 8.
Figure 19:
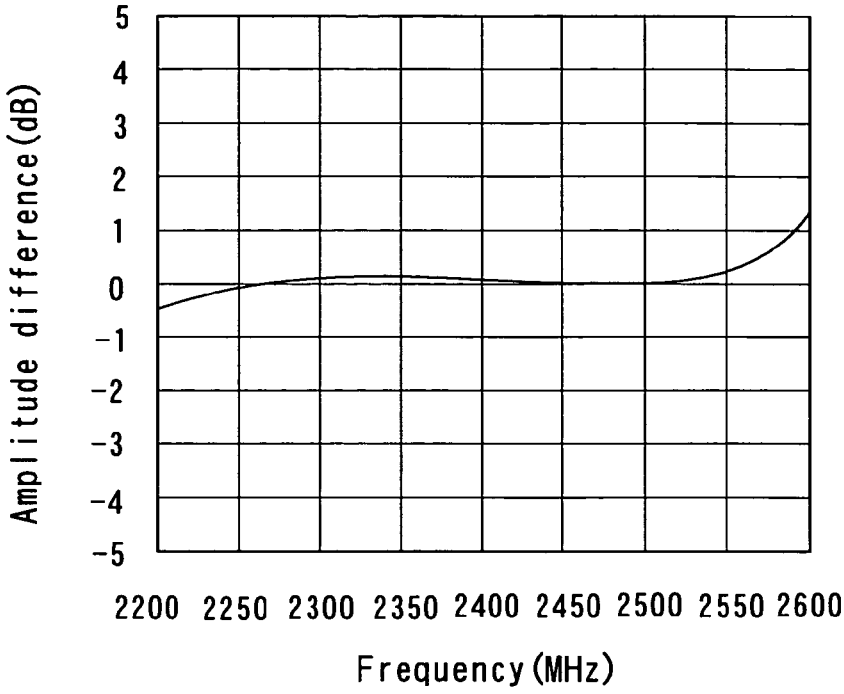
FIG. 19 is a plot showing the frequency characteristic of amplitude difference of output signals of the balanced outputs of the multi-layer band-pass filter of FIG. 8.
Figure 20:
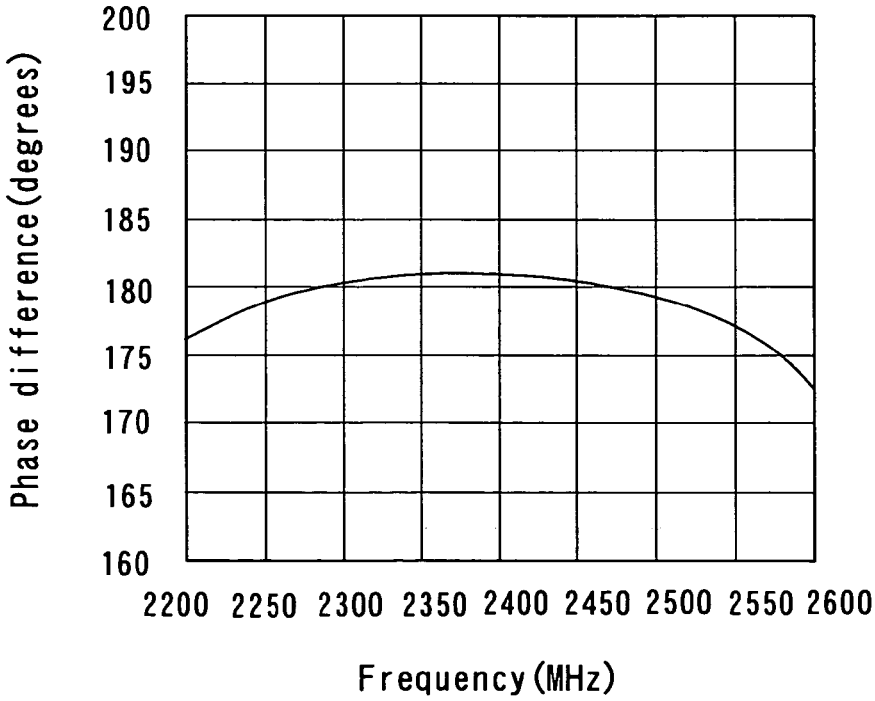
FIG. 20 is a plot showing the frequency characteristic of phase difference of output signals of the balanced outputs of the multi-layer band-pass filter of FIG. 8.

FIG. 17 to FIG. 20 illustrate examples of characteristics of the multi-layer band-pass filter 1 of the first configuration example. FIG. 17 shows the attenuation and insertion loss characteristics of the band-pass filter 1. FIG. 18 shows the reflection loss characteristic of the band-pass filter 1. As shown in FIG. 17 and FIG. 18, it is noted that the band-pass filter 1 functions as a band-pass filter for selectively allowing signals of frequencies within a specific frequency band to pass. FIG. 19 shows the frequency characteristic of amplitude difference of output signals of the balanced outputs 3A and 3B of the band-pass filter 1. FIG. 20 shows the frequency characteristic of phase difference of output signals of the balanced outputs 3A and 3B of the band-pass filter 1. As shown in FIG. 19 and FIG. 20, it is noted that balanced signals are outputted from the balanced outputs 3A and 3B in the band-pass filter 1.

According to the bands-pass filter 1 of the embodiment as thus described, it is possible to produce a balanced signal made up of two signals that are nearly 180 degrees out of phase with each other and that have nearly equal amplitudes.

According to the bands-pass filter 1 of the embodiment, it is possible to produce balanced signals without using any balun. Furthermore, a plurality of resonators 40 are integrated through the use of the multi-layer substrate 30. These features of the embodiment enable a reduction in size of the band-pass filter 1.

The bands-pass filter 1 of the embodiment comprises a capacitor provided in at least one of a location between the unbalanced input 2 and the input resonator 40I and a location between the half-wave resonator 41A and each of the balanced outputs 3A and 3B. Since this capacitor is made up of part of the multi-layer substrate, it is possible to easily form the capacitor having a high capacitance and to easily change the capacitance of the capacitor. As a result, it is easy to adjust the characteristics of the band-pass filter 1.

According to the embodiment, if the capacitor 44 is provided between the unbalanced input 2 and the input resonator 40I, it is possible to block the direct current flowing between the unbalanced input 2 and the input resonator 40I. Similarly, if the capacitors 45A and 45B are provided between the half-wave resonator 41A and the balanced outputs 3A and 3B, it is possible to block the direct current flowing between the half-wave resonator 41A and the balanced outputs 3A and 3B. Therefore, according to the embodiment, the capacitors 44, 45A and 45B prevent unwanted direct currents from flowing through other elements, such as integrated circuits (ICs) connected to the band-pass filter 1. It is thereby possible to protect the other elements. When an external capacitor for protecting such elements is provided between the band-pass filter and the elements, it is required that matching between the band-pass filter and the elements be established, considering the external capacitor. According to the embodiment, in contrast, the band-pass filter 1 includes the capacitors 44, 45A and 45B. Therefore, it is possible to design the band-pass filter 1 such that matching between the band-pass filter 1 and an external circuit is established, with consideration given to the capacitors 44, 45A and 45B. It is thus easy to establish matching between the band-pass filter 1 and an external circuit.

SECOND EMBODIMENT

Figure 21:
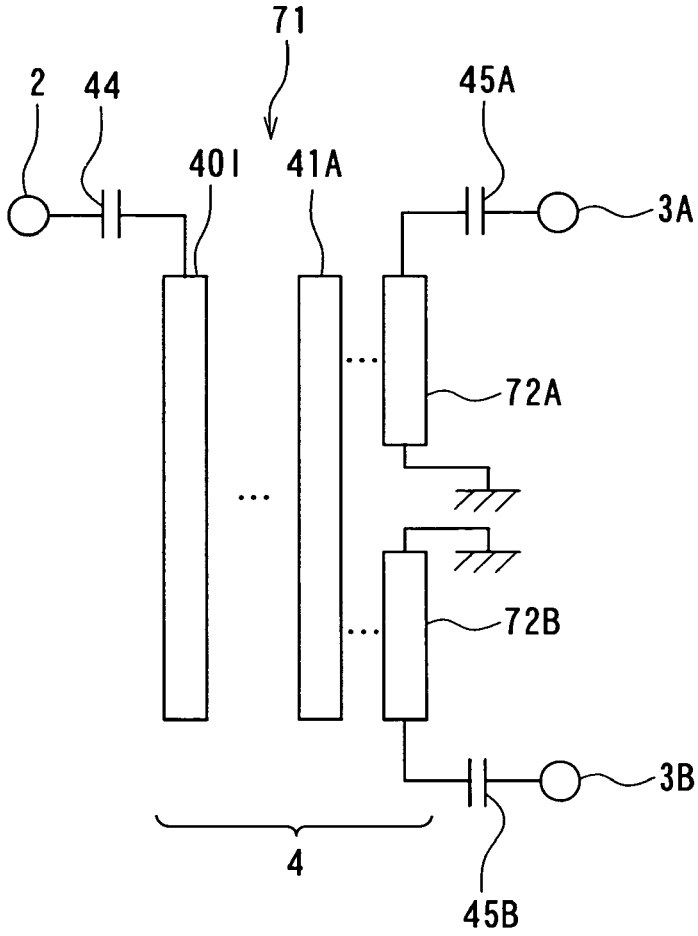
FIG. 21 illustrates a basic configuration of a multi-layer band-pass filter of a second embodiment of the invention.

Reference is now made to FIG. 21 to describe a basic configuration of a multi-layer band-pass filter of a second embodiment of the invention. As shown in FIG. 21, the multi-layer band-pass filter 71 of the second embodiment comprises: the single unbalanced input 2 for receiving unbalanced signals; the two balanced outputs 3A and 3B for outputting balanced signals; and the band-pass filter section 4 provided between the unbalanced input 2 and the balanced outputs 3A and 3B. The band-pass filter section 4 incorporates a plurality of resonators each of which is made up of a TEM line. The multi-layer band-pass filter 71 further comprises a multi-layer substrate used for integrating the resonators. The resonators making up the band-pass filter section 4 have equal resonant frequencies. In addition, the resonators are arranged such that adjacent ones are electromagnetically coupled to each other. As a result, the resonators exhibit a function of a band-pass filter for selectively allowing signals of frequencies within a specific frequency band to pass.

The band-pass filter section 4 incorporates, as the resonators, the half-wave resonator 41A for balanced output that is made up of the half-wave resonator 41 having open-circuited ends, and quarter-wave resonators 72A and 72B for balanced output that are provided between the half-wave resonator 41A and the balanced outputs 3A and 3B. Each of the quarter-wave resonators 72A and 72B for balanced output is made up of the quarter-wave resonator 43. There are provided a plurality of stages of the quarter-wave resonators 72A and 72B, each stage consisting of a pair of the resonators 72A and 72B. The balanced outputs 3A and 3B are connected through the output capacitors 45A and 45B to a pair of quarter-wave resonators 72A and 72B of the final stage, respectively. The unbalanced input 2 is connected to the input resonator 40I through the input capacitor 44. In the second embodiment, as in the first embodiment, only the capacitor 44 among the capacitors 44, 45A and 45B may be provided, and the balanced outputs 3A and 3B may be directly connected to the quarter-wave resonators 72A and 72B, respectively. Alternatively, only the capacitors 45A and 45B among the capacitors 44, 45A and 45B may be provided, and the unbalanced input 2 may be directly connected to the input resonator 40I.

The band-pass filter section 4 may further incorporate one resonator or more provided between the unbalanced input 2 and the half-wave resonator 41A for balanced output. Such a resonator or resonators may be any of a half-wave resonator having open-circuited ends, a half-wave resonator having short-circuited ends, and a quarter-wave resonator. FIG. 21 illustrates an example in which at least the input resonator 40I is provided between the unbalanced input 2 and the half-wave resonator 41A. However, the unbalanced input 2 may be connected to the half-wave resonator 41A without providing any resonator therebetween, so that the half-wave resonator 41A also functions as the input resonator 401.

The operation of the multi-layer band-pass filter 71 of the second embodiment will now be described. Discussions will be made first as to the case in which the quarter-wave resonators 72A and 72B of the final stage are only provided as the resonators 72A and 72B for balanced output. In this case, one of the resonators, i.e., the resonator 72A, is coupled to a half portion of the half-wave resonator 41A taken along the length thereof, and the other one, i.e., the resonator 72B, is coupled to the other half portion of the half-wave resonator 41A taken along the length thereof.

As described in the first embodiment, one half portion and the other half portion of the resonator 41A taken along the length thereof have electric fields 180 degrees out of phase with each other. Consequently, the quarter-wave resonators 72A and 72B have electric fields 180 degrees out of phase with each other, too. As a result, it is possible that balanced signals are outputted from the balanced outputs 3A and 3B.

According to the bands-pass filter 71 of the second embodiment as thus described, it is possible to produce balanced signals without using any balun, as in the first embodiment. Furthermore, according to the band-pass filter 71 of the second embodiment, a plurality of resonators 40 are integrated through the use of the multi-layer substrate 30. These features of the embodiment enable a reduction in size of the band-pass filter 71.

The band-pass filter 71 of the embodiment comprises a capacitor provided in at least one of a location between the unbalanced input 2 and the input resonator 40I and a location between each of the balanced outputs 3A and 3B and the quarter-wave resonator 72A and 72B. As a result, it is easy to adjust the characteristics of the band-pass filter 71.

Figure 22:
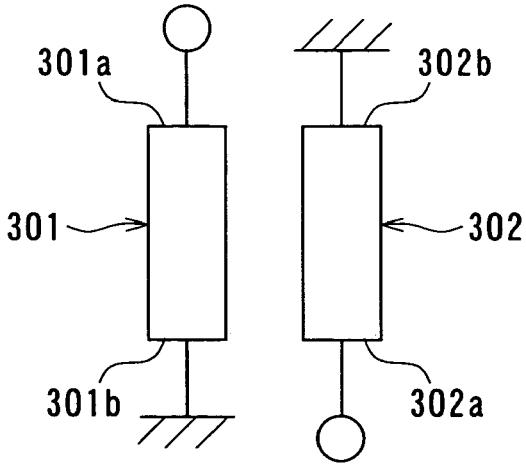
FIG. 22 illustrates interdigital coupling as a method of coupling resonators.
Figure 23:
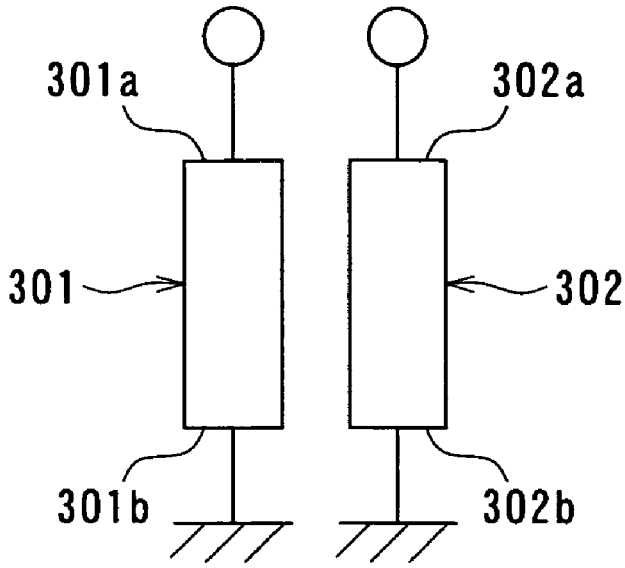
FIG. 23 illustrates combline coupling as a method of coupling resonators.

Reference is now made to FIG. 22 to FIG. 28 to describe methods of coupling the quarter-wave resonators 72A and 72B to the half-wave resonator 41A. Interdigital coupling and combline coupling are available as methods of coupling two resonators to each other. As shown in FIG. 22, interdigital coupling is a method that provides a configuration in which resonators 301 and 302 are arranged such that an open-circuited end 301*a* of one resonator 301 is opposed to a short-circuited end 302*b* of the other resonator 302, and a short-circuited end 301*b* of the resonator 301 is opposed to an open-circuited end 302*a* of the resonator 302. As shown in FIG. 23, combline coupling is a method that provides a configuration in which the resonators 301 and 302 are arranged such that the open-circuited end 301*a* of the resonator 301 is opposed to the open-circuited end 302*a* of the resonator 302, and the short-circuited end 301*b* of the resonator 301 is opposed to the short-circuited end 302*b* of the resonator 302. Interdigital coupling provides coupling of higher intensity than combline coupling.

Figure 24:
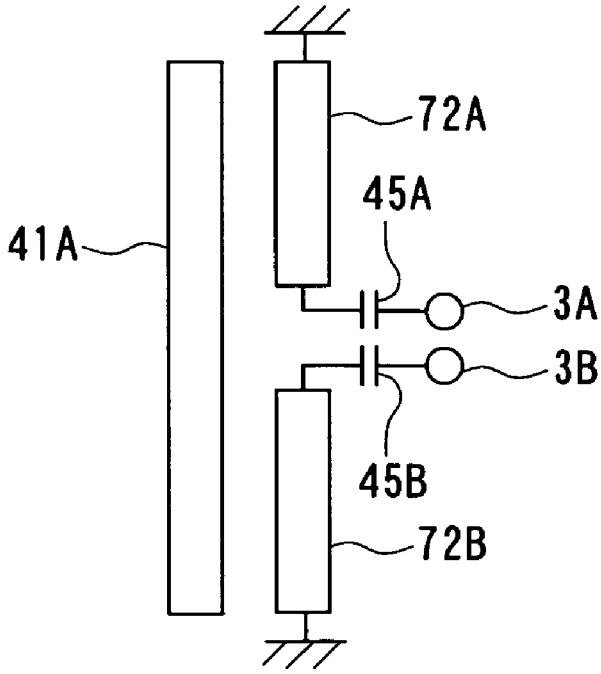
FIG. 24 illustrates a method of coupling a quarter-wave resonator for balanced output to a half-wave resonator for balanced output.
Figure 25:
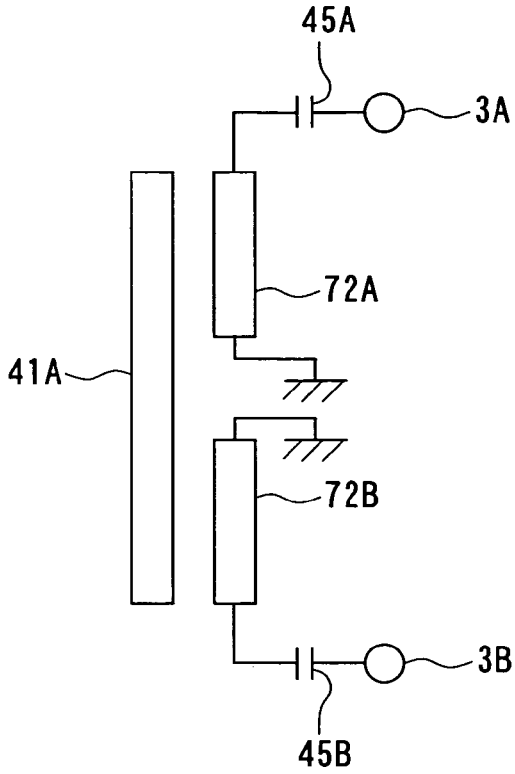
FIG. 25 illustrates a method of coupling the quarter-wave resonator for balanced output to the half-wave resonator for balanced output.
Figure 26:
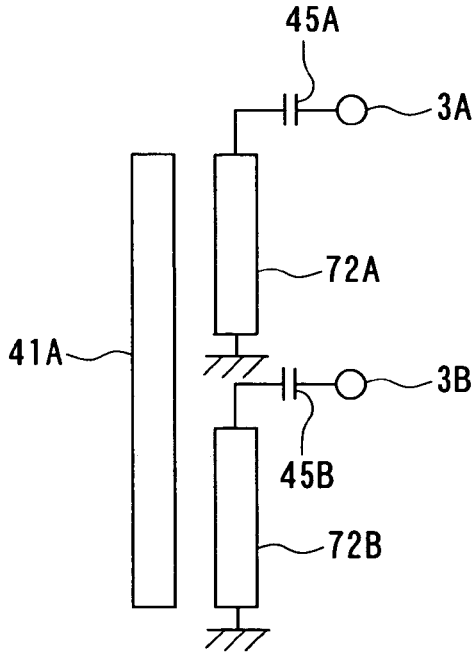
FIG. 26 illustrates a method of coupling the quarter-wave resonator for balanced output to the half-wave resonator for balanced output.

To couple the quarter-wave resonators 72A and 72B to the half-wave resonator 41A, three methods shown in FIG. 24 to FIG. 26 are possible. The method of FIG. 24 provides coupling in which the quarter-wave resonators 72A and 72B are both coupled to the half-wave resonator 41A by means of interdigital coupling. The method of FIG. 25 provides coupling in which the quarter-wave resonators 72A and 72B are both coupled to the half-wave resonator 41A by means of combline coupling. The method of FIG. 26 provides coupling in which one of the quarter-wave resonators 72A and 72B (the resonator 72B in FIG. 26) is coupled to the half-wave resonator 41A by means of interdigital coupling, while the other one of the quarter-wave resonators 72A and 72B (the resonator 72A in FIG. 26) is coupled to the half-wave resonator 41A by means of combline coupling.

According to the method of FIG. 26, the balance of amplitudes of balanced signals is affected. Therefore, it is preferred that the quarter-wave resonators 72A and 72B are coupled to the half-wave resonator 41A by means of the same coupling method, as shown in FIG. 24 or FIG. 25.

Figure 27:
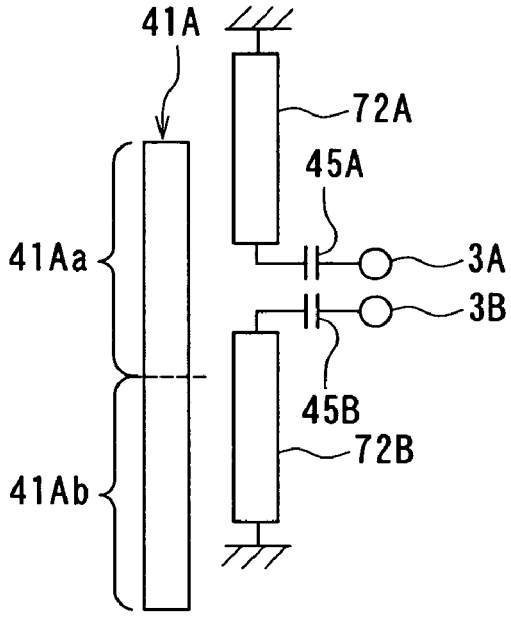
FIG. 27 illustrates a method of coupling the quarter-wave resonator for balanced output to the half-wave resonator for balanced output.
Figure 28:
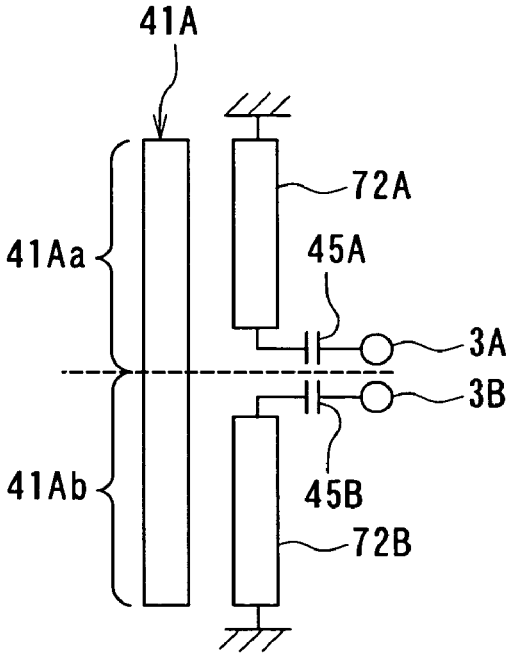
FIG. 28 illustrates a method of coupling the quarter-wave resonator for balanced output to the half-wave resonator for balanced output.

As shown in FIG. 27, the balance of balanced signals is affected if one of the quarter-wave resonators 72A and 72B (the resonator 72B in FIG. 27) is coupled to both of a half portion 41Aa and the other half portion 41Ab of the half-wave resonator 41A taken along the length thereof. Therefore, as shown in FIG. 28, it is preferred that the quarter-wave resonator 72A is only coupled to the one of the half portions, i.e., the half portion 41Aa, of the half-wave resonator 41A taken along the length thereof, and that the quarter-wave resonator 72B is only coupled to the other half portion 41Ab of the half-wave resonator 41A.

The operation of the multi-layer band-pass filter 71 wherein a plurality of stages of the quarter-wave resonators 72A and 72B are provided as the resonators 72A and 72B for balanced output will now be described. In this case, one of a pair of the resonators 72A and 72B, i.e., the resonator 72A, of the first stage closest to a half-wave resonator 71A is coupled to a half portion of the half-wave resonator 41A taken along the length thereof, and the other one, i.e., the resonator 72B, is coupled to the other half portion of the half-wave resonator 41A. A resonator 72A of the next stage is coupled to a resonator 72A of the previous stage. A resonator 72B of the next stage is coupled to a resonator 72B of the previous stage.

As stated above, one half portion and the other half portion of the resonator 41A taken along the length thereof have electric fields 180 degrees out of phase with each other. Consequently, the quarter-wave resonators 72A and 72B of each stage have electric fields 180 degrees out of phase with each other, too. As a result, it is possible that balanced signals are outputted from the balanced outputs 3A and 3B.

Figure 29:
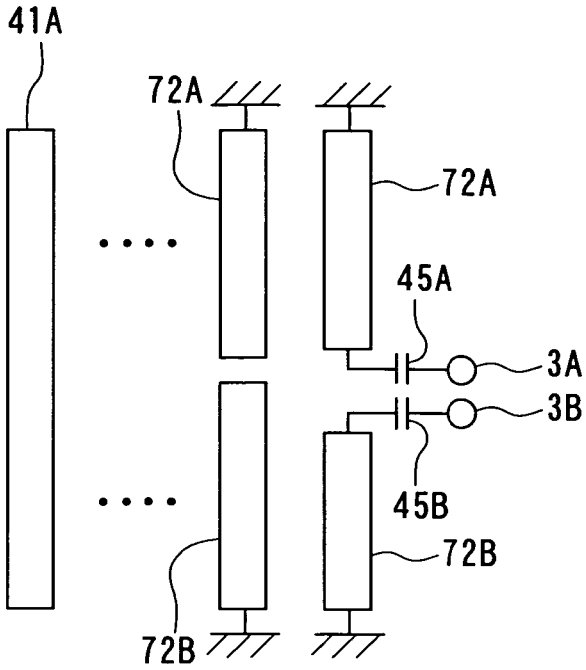
FIG. 29 illustrates a method of coupling quarter-wave resonators for balanced output of adjacent two stages to each other.
Figure 30:
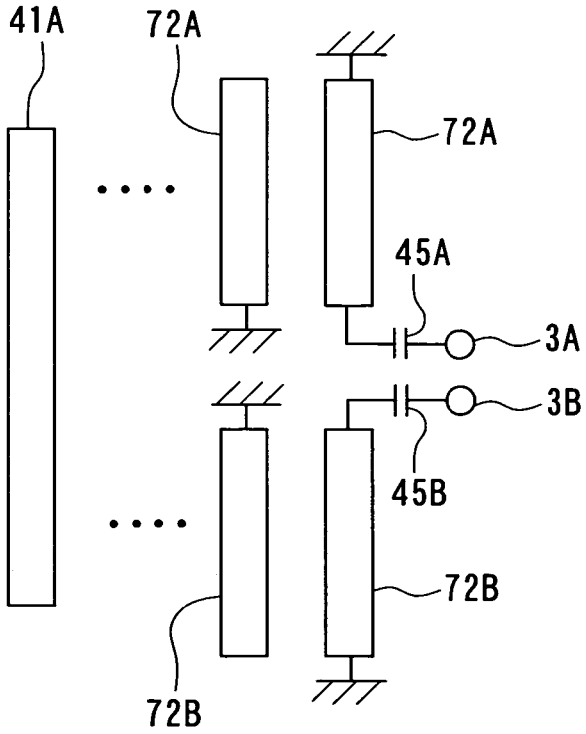
FIG. 30 illustrates a method of coupling the quarter-wave resonators for balanced output of the adjacent two stages to each other.

Because of the same reason as the description referring to FIG. 24 to FIG. 26, it is preferred that the quarter-wave resonators 72A and 72B of the first stage are coupled to the half-wave resonator 41A by means of the same coupling method. Furthermore, because of the same reason, as shown in FIG. 29 or FIG. 30, it is preferred that a pair of quarter-wave resonators 72A and 72B of each stage are coupled to a pair of quarter-wave resonators 72A and 72B of the previous or next stage by means of the same coupling method. FIG. 29 illustrates a case in which the resonators 72A and the resonators 72B of adjacent two stages are coupled to each other by means of combline coupling. FIG. 30 illustrates a case in which the resonators 72A and the resonators 72B of adjacent two stages are coupled to each other by means of interdigital coupling.

Because of the same reason as the description referring to FIG. 27 and FIG. 28, it is preferred that the quarter-wave resonator 72A of the first stage is coupled only to one half portion 41Aa of the half-wave resonator 41A taken along the length thereof, and that the quarter-wave resonator 72B of the first stage is coupled only to the other half portion 41Ab of the half-wave resonator 41A taken along the length thereof.

The multi-layer substrate 30 of the second embodiment may have such a configuration that one or more stages of the quarter-wave resonators 72A and 72B are disposed between the conductor layer for the half-wave resonator 41A and the conductor layers for the balanced outputs 3A and 3B. The multi-layer substrate 30 of the second embodiment may have an appearance similar to that of the multi-layer substrate 30 of FIG. 10. The remainder of configuration, operation and effects of the second embodiment are similar to those of the first embodiment.

THIRD EMBODIMENT

Reference is now made to FIG. 31 to FIG. 38 to describe a multi-layer band-pass filter of a third embodiment of the invention. The multi-layer band-pass filter of the third embodiment is similar to the band-pass filter of the first or second embodiment, wherein at least one of the resonators making up the band-pass filter section 4 has such a shape that the capacitance or inductance is higher compared with the case in which the resonator is rectangle-shaped.

Four examples of specific shape of the resonator of the third embodiment will now be described.

FIRST EXAMPLE OF SHAPE OF RESONATOR

Figure 31:
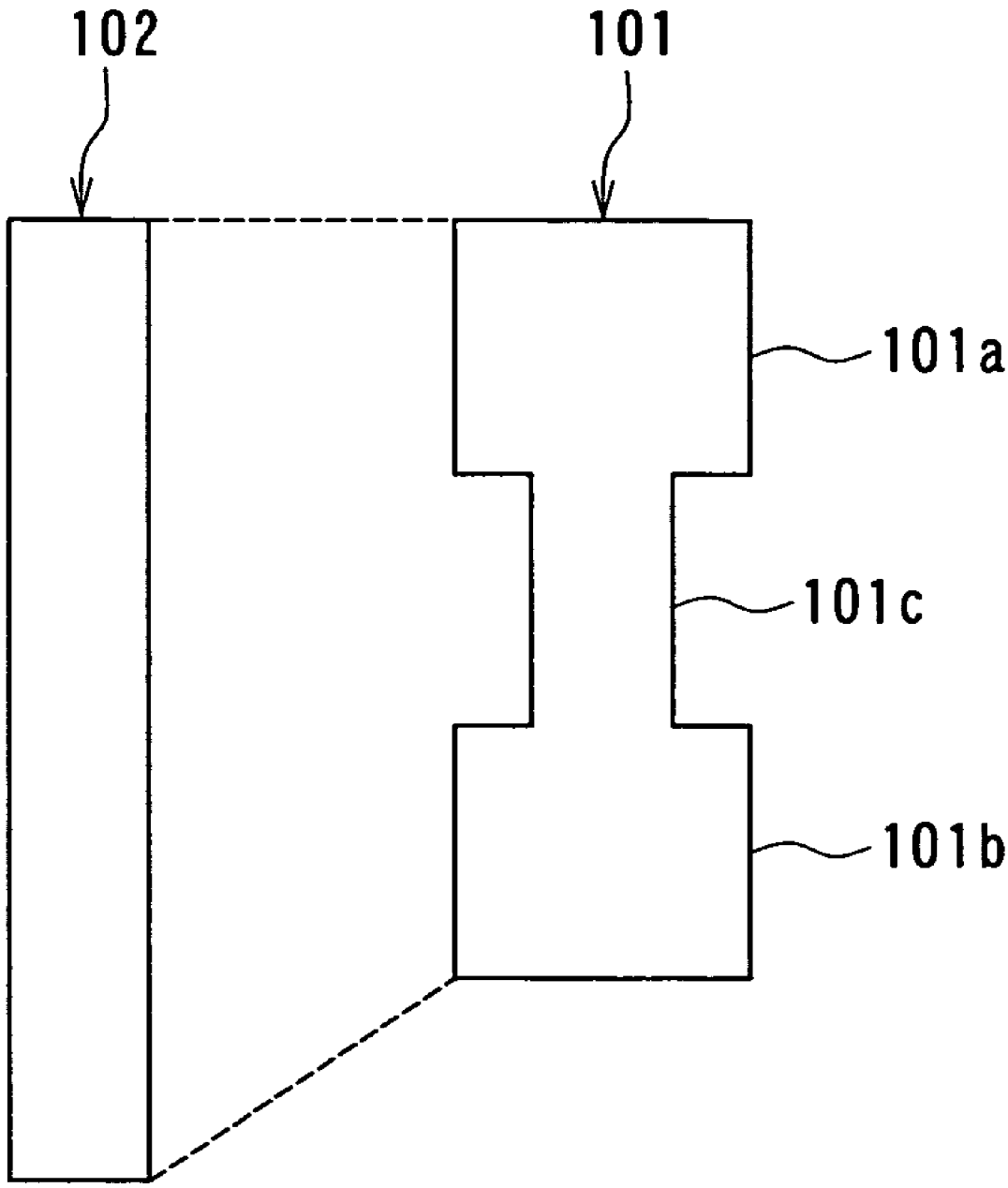
FIG. 31 illustrates a first example of the shape of a resonator of a third embodiment of the invention.

FIG. 31 illustrates a resonator 101 of the first example and a rectangle-shaped resonator 102 for comparison with the resonator 101. Each of the resonators 101 and 102 is a half-wave resonator having open-circuited ends. The resonators 101 and 102 have equal resonant frequencies. In the resonator 101 two portions 101*a* and 101*b* near the open-circuited ends each have a width greater than the width of a portion 101*c* between the portions 101*a* and 101*b*. The width of the portion 101*c* is equal to the width of the resonator 102. In the resonator 101 the capacitance near the open-circuited ends is higher compared with the resonator 102. As a result, the physical length of the resonator 101 is smaller than the physical length of the resonator 102.

Figure 32:
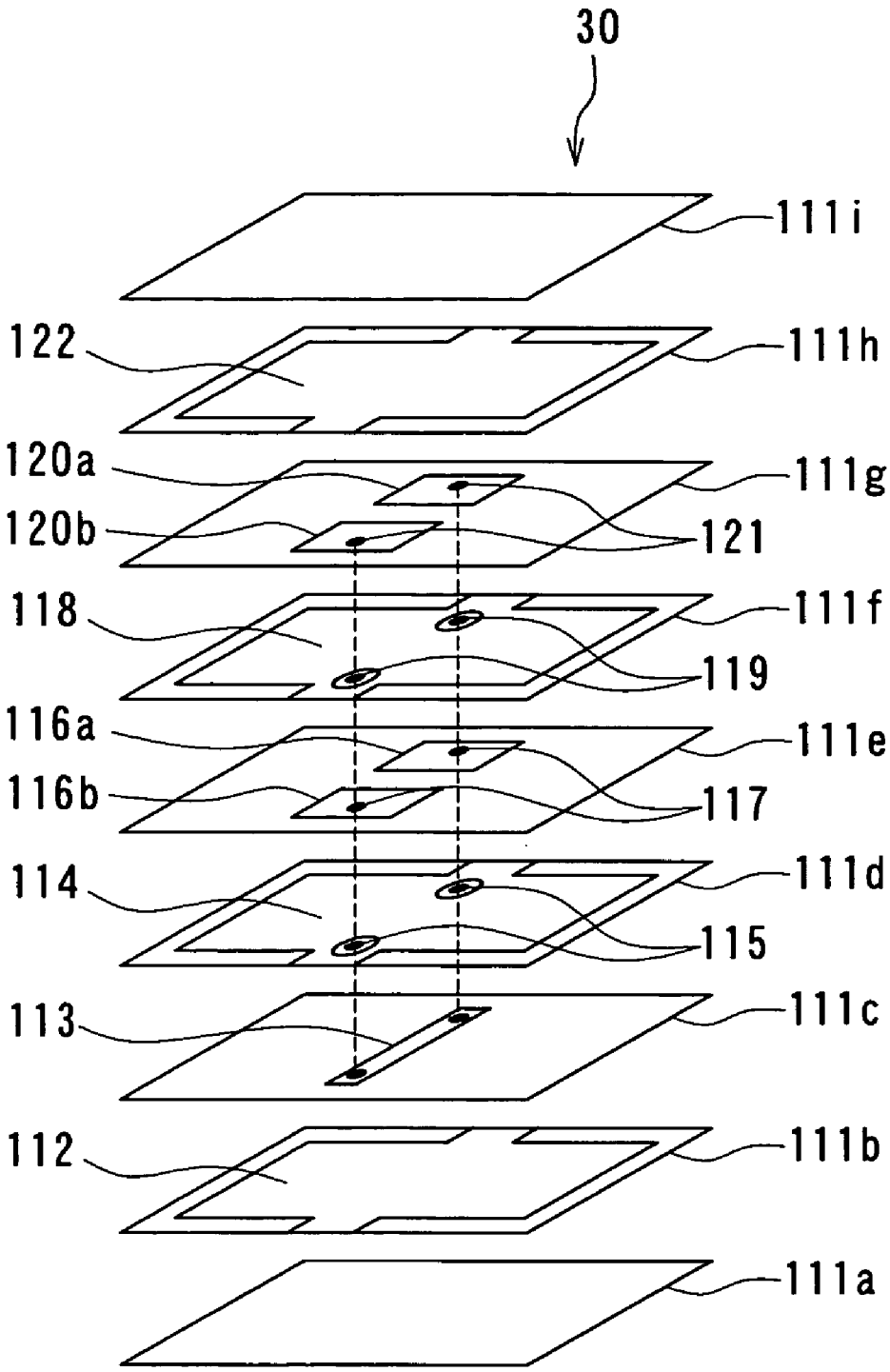
FIG. 32 is an exploded perspective view illustrating an example of configuration of a multi-layer substrate for implementing the resonator of FIG. 31.

FIG. 32 is an exploded perspective view illustrating an example of configuration of the multi-layer substrate 30 for implementing the resonator 101 of FIG. 31. FIG. 32 illustrates only a portion of the multi-layer substrate 30 near the resonator 101. The multi-layer substrate 30 of FIG. 32 incorporates nine dielectric layers 111*a* to 111*i* stacked from bottom to top. A conductor layer 112 for ground is formed on the top surface of the dielectric layer 111*b*. A conductor layer 113 that is long in one direction is formed on the top surface of the dielectric layer 111*c*. A conductor layer 114 for ground and two through holes 115 are formed on the top surface of the dielectric layer 111*d*. The through holes 115 are not in contact with the conductor layer 114. Two conductor layers 116*a* and 116*b* for capacitors and two through holes 117 are formed on the top surface of the dielectric layer 111*e*. The through holes 117 are connected to the conductor layers 116*a* and 116*b*, respectively. A conductor layer 118 for ground and two through holes 119 are formed on the top surface of the dielectric layer 111*f*. The through holes 119 are not in contact with the conductor layer 118. Two conductor layers 120*a* and 120*b* for capacitors and two through holes 121 are formed on the top surface of the dielectric layer 111*g*. The through holes 121 are connected to the conductor layers 120*a* and 120*b*, respectively. A conductor layer 122 for ground is formed on the top surface of the dielectric layer 111*h*.

Each of the conductor layers 116*a*, 116*b*, 120*a* and 120*b* has a width greater than the width of the conductor layer 113. The conductor layers 116*a* and 120*a* are connected to a portion near one of the ends of the conductor layer 113 via the through holes 115, 117, 119 and 121. The conductor layers 116*b* and 120*b* are connected to a portion near the other of the ends of the conductor layer 113 via the through holes 115, 117, 119 and 121. The conductor layer 113 and the conductor layers 116*a*, 116*b*, 120*a* and 120*b* for capacitors make up the resonator 101 of FIG. 31. The conductor layers 116*a* and 120*a* correspond to the portion 101*a* of FIG. 31. The conductor layers 116*b* and 120*b* correspond to the portion 101*b* of FIG. 31.

SECOND EXAMPLE OF SHAPE OF RESONATOR

Figure 33:
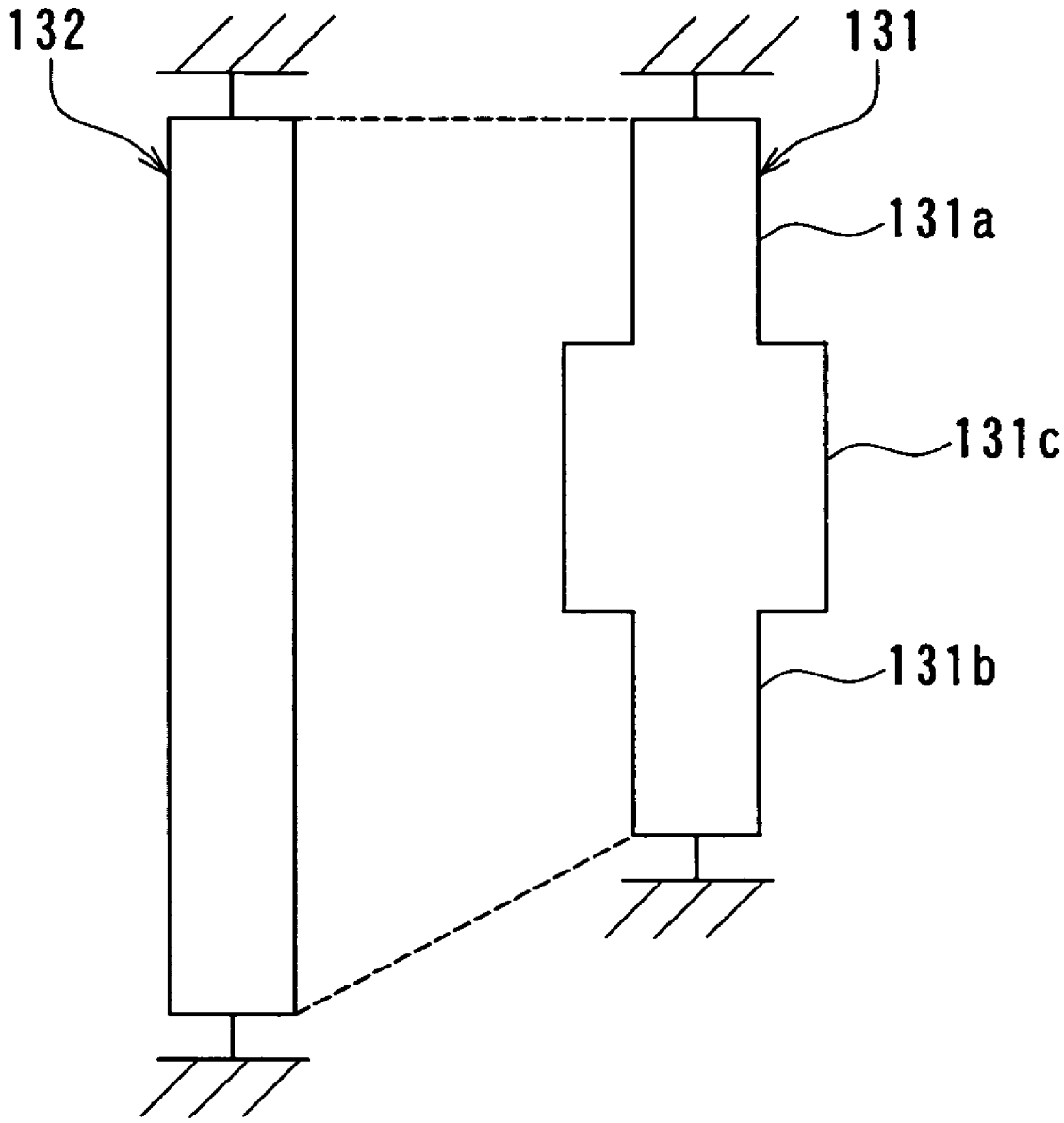
FIG. 33 illustrates a second example of the shape of the resonator of the third embodiment of the invention.

FIG. 33 illustrates a resonator 131 of the second example and a rectangle-shaped resonator 132 for comparison with the resonator 131. Each of the resonators 131 and 132 is a half-wave resonator having short-circuited ends. The resonators 131 and 132 have equal resonant frequencies. In the resonator 131, a portion 131*c* near the middle of the length thereof has a width greater than the width of each of two portions 131*a* and 131*b* near the short-circuited ends. The width of each of the portions 131*a* and 131*b* is equal to the width of the resonator 132. In the resonator 131, the capacitance near the middle of the length thereof is higher compared with the resonator 132. As a result, the physical length of the resonator 131 is smaller than the physical length of the resonator 132.

Figure 34:
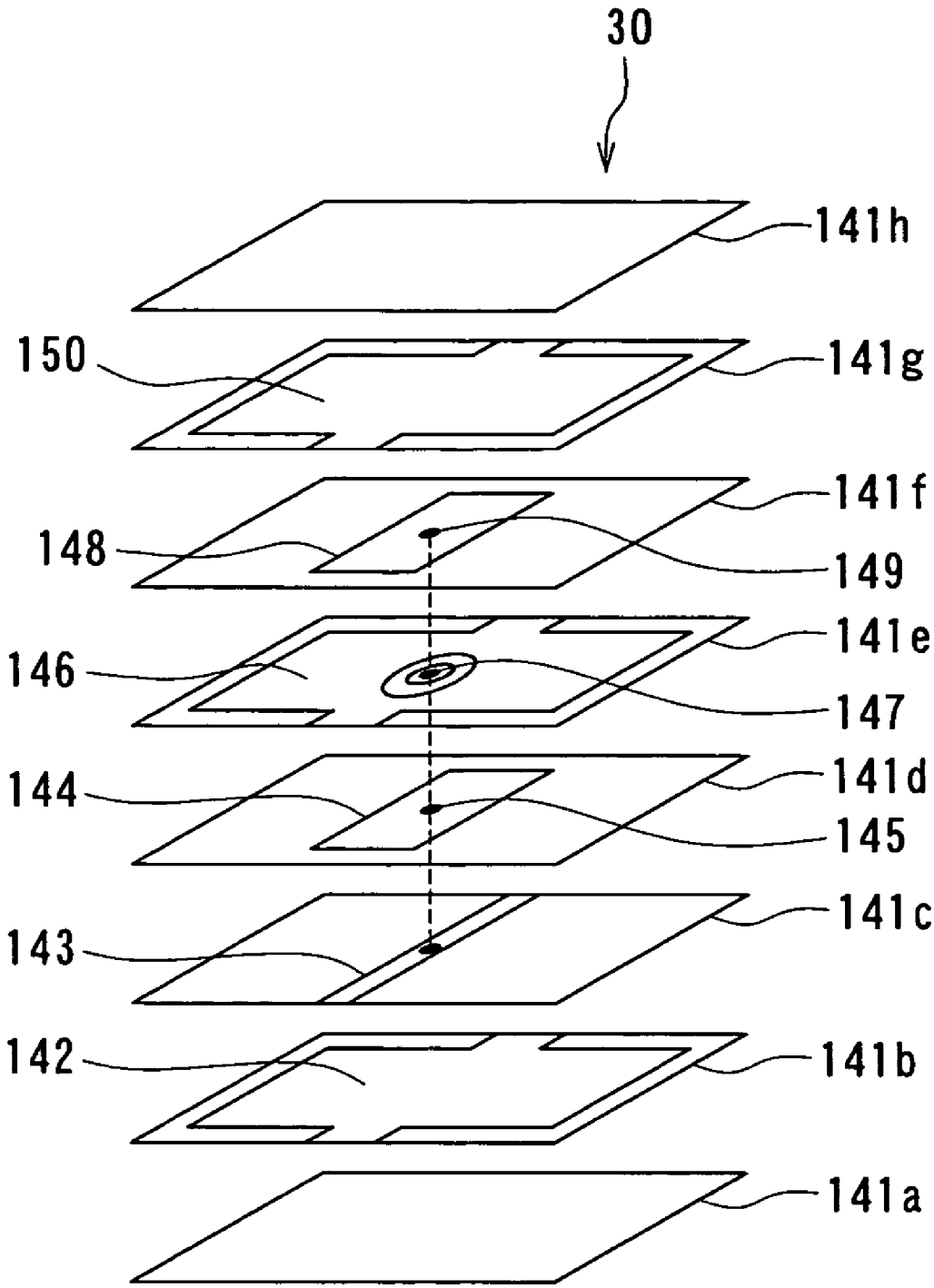
FIG. 34 is an exploded perspective view illustrating an example of configuration of a multi-layer substrate for implementing the resonator of FIG. 33.

FIG. 34 is an exploded perspective view illustrating an example of configuration of the multi-layer substrate 30 for implementing the resonator 131 of FIG. 33. FIG. 34 illustrates only a portion of the multi-layer substrate 30 near the resonator 131. The multi-layer substrate 30 of FIG. 34 incorporates eight dielectric layers 141*a* to 141*h* stacked from bottom to top. A conductor layer 142 for ground is formed on the top surface of the dielectric layer 141*b*. A conductor layer 143 that is long in one direction is formed on the top surface of the dielectric layer 141*c*. A conductor layer 144 for a capacitor and a through hole 145 connected to the conductor layer 144 are formed on the top surface of the dielectric layer 141*d*. A conductor layer 146 for ground and a through hole 147 are formed on the top surface of the dielectric layer 141*e*. The through hole 147 is not in contact with the conductor layer 146. A conductor layer 148 for a capacitor and a through hole 149 connected to the conductor layer 148 are formed on the top surface of the dielectric layer 141*f*. A conductor layer 150 for ground is formed on the top surface of the dielectric layer 141*g*.

Each of the conductor layers 144 and 148 has a width greater than the width of the conductor layer 143. The conductor layers 144 and 148 are connected via the through holes 145, 147 and 149 to the middle portion of the length of the conductor layer 143. The conductor layer 143 and the conductor layers 144 and 148 for capacitors make up the resonator 131 of FIG. 33.

THIRD EXAMPLE OF SHAPE OF RESONATOR

Figure 35:
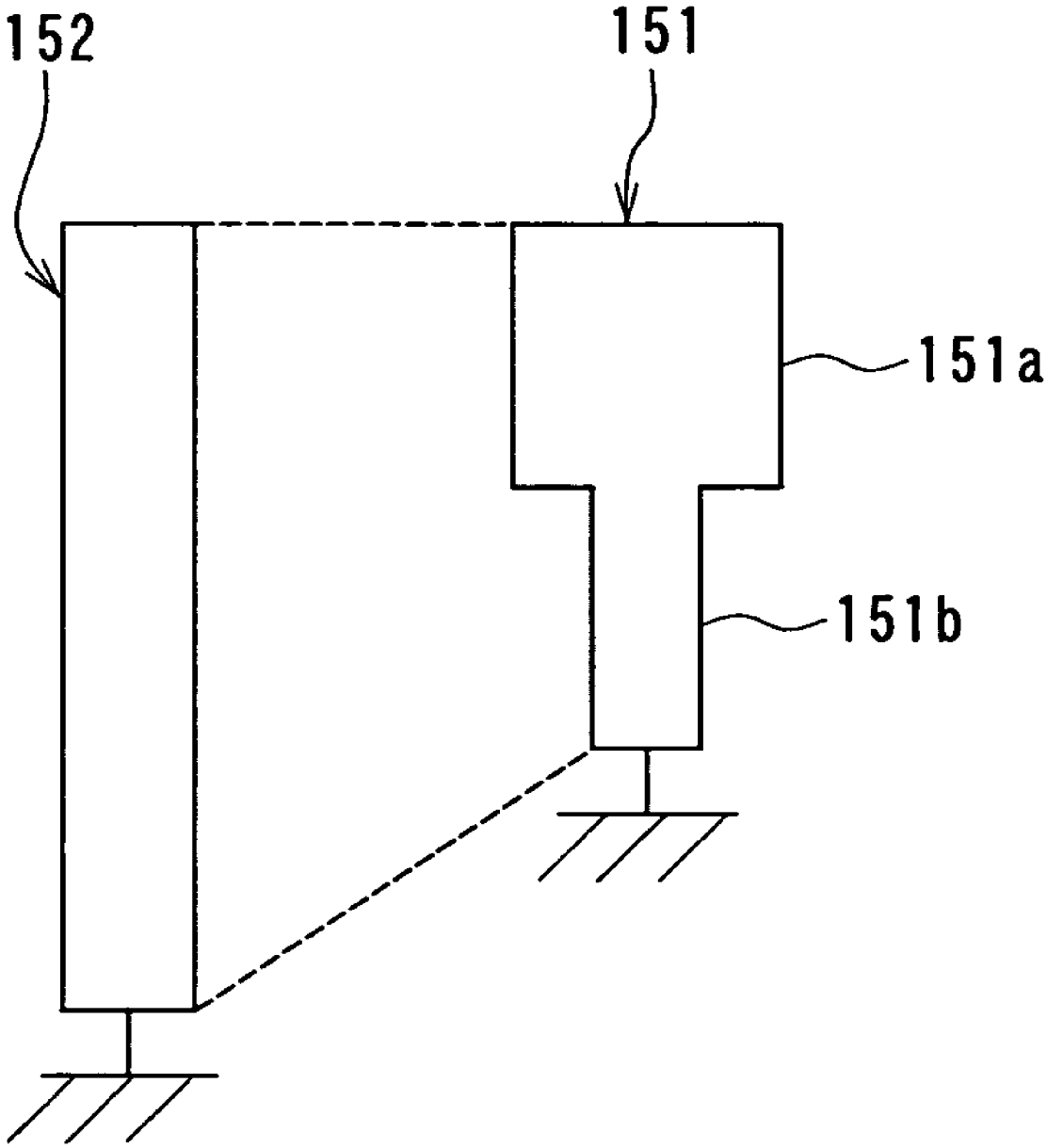
FIG. 35 illustrates a third example of the shape of the resonator of the third embodiment of the invention.

FIG. 35 illustrates a resonator 151 of the third example and a rectangle-shaped resonator 152 for comparison with the resonator 151. Each of the resonators 151 and 152 is a quarter-wave resonator having an end short-circuited and the other end open-circuited. The resonators 151 and 152 have equal resonant frequencies. In the resonator 151, a portion 151*a* near the open-circuited end has a width greater than the width of a portion 151*b* near the short-circuited end. The width of the portion 151*b* is equal to the width of the resonator 152. In the resonator 151, the capacitance in the portion 151*a* near the open-circuited end is higher compared with the resonator 152. As a result, the physical length of the resonator 151 is smaller than the physical length of the resonator 152.

Figure 36:
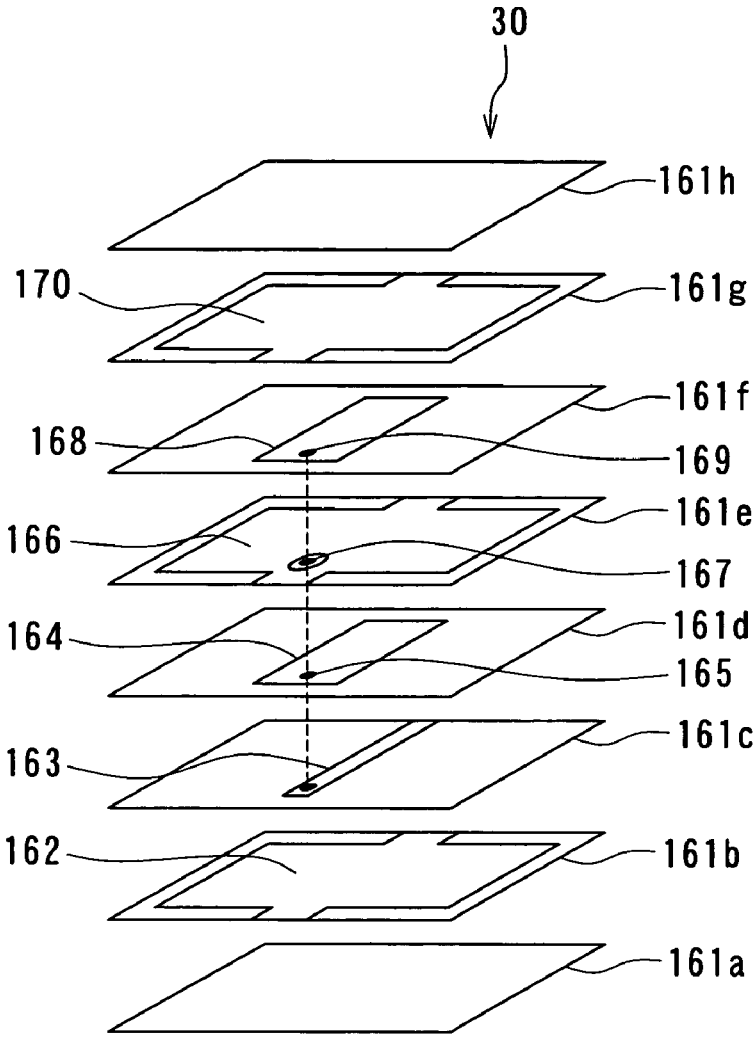
FIG. 36 is an exploded perspective view illustrating an example of configuration of a multi-layer substrate for implementing the resonator of FIG. 35.

FIG. 36 is an exploded perspective view illustrating an example of configuration of the multi-layer substrate 30 for implementing the resonator 151 of FIG. 35. FIG. 36 illustrates only a portion of the multi-layer substrate 30 near the resonator 151. The multi-layer substrate 30 of FIG. 36 incorporates eight dielectric layers 161*a* to 161*h* stacked from bottom to top. A conductor layer 162 for ground is formed on the top surface of the dielectric layer 161*b*. A conductor layer 163 that is long in one direction is formed on the top surface of the dielectric layer 161*c*. A conductor layer 164 for a capacitor and a through hole 165 connected to the conductor layer 164 are formed on the top surface of the dielectric layer 161*d*. A conductor layer 166 for ground and a through hole 167 are formed on the top surface of the dielectric layer 161*e*. The through hole 167 is not in contact with the conductor layer 166. A conductor layer 168 for a capacitor and a through hole 169 connected to the conductor layer 168 are formed on the top surface of the dielectric layer 161*f*. A conductor layer 170 for ground is formed on the top surface of the dielectric layer 161*g*.

Each of the conductor layers 164 and 168 has a width greater than the width of the conductor layer 163. The conductor layers 164 and 168 are connected via the through holes 165, 167 and 169 to the portion near the open-circuited end of the conductor layer 163. The conductor layer 163 and the conductor layers 164 and 168 for capacitors make up the resonator 151 of FIG. 35.

Figure 37:
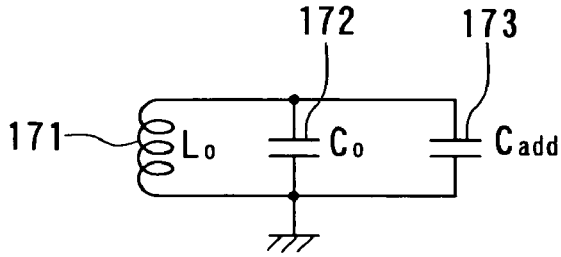
FIG. 37 is a schematic diagram illustrating an equivalent circuit of the resonators of the first to third examples.

The reason why the resonators of the first to third examples can achieve a smaller physical length than that of a rectangle-shaped resonator will now be described. In each of the resonators of the first to third examples, a portion including the portion in which the electric field is maximum in the resonator has a width greater than the other portion. FIG. 37 illustrates an equivalent circuit of the resonator having such a shape. The circuit of FIG. 37 incorporates an inductor 171, a capacitor 172 and a capacitor 173 that are connected in parallel. Each of the inductor 171, the capacitor 172 and the capacitor 173 has an end grounded. The inductor 171 and the capacitor 172 correspond to inductance components and capacitance components of a rectangle-shaped resonator. The capacitor 173 corresponds to capacitance components created by increasing the width of a portion of this rectangle-circuited shaped resonator.

Here, the inductance of the inductor 171 is $L_0$, the capacitance of the capacitor 172 is $C_0$, and the capacitance of the capacitor 173 is $C_{add}$. The resonant frequency of the circuit made up of the circuit of FIG. 37 from which the capacitor 173 is excluded is $f_0$, and the resonant frequency of the circuit of FIG. 37 is $f_1$. The resonant frequencies $f_0$ and $f_1$ are expressed by the equations below.

$$f_0=1/\{2\pi\sqrt{(L_0C_0)}\}$$

$$f_1=1/[2\pi\sqrt{\{L_0(C_0+C_{add})\}}]$$

As seen from the two equations above, the resonant frequency of a rectangle-shaped resonator becomes lower if the width of a portion thereof is increased to generate the capacitance $C_{add}$. Therefore, if the resonant frequency is not intended to be changed, increasing the width of a portion of a rectangle-shaped resonator can reduce the physical length of the resonator.

FOURTH EXAMPLE OF SHAPE OF RESONATOR

A resonator of the fourth example has such a shape that the inductance components in a portion near the portion in which the electric field is zero in the resonator are greater compared with a rectangle-shaped resonator. To be specific, in the resonator of the fourth example, a spiral-shaped inductor is formed near the portion in which the electric field is zero in the resonator. According to the resonator having such a shape, it is possible that the physical length of the region the resonator occupies is made smaller than the physical length of the rectangle-shaped resonator.

Figure 38:
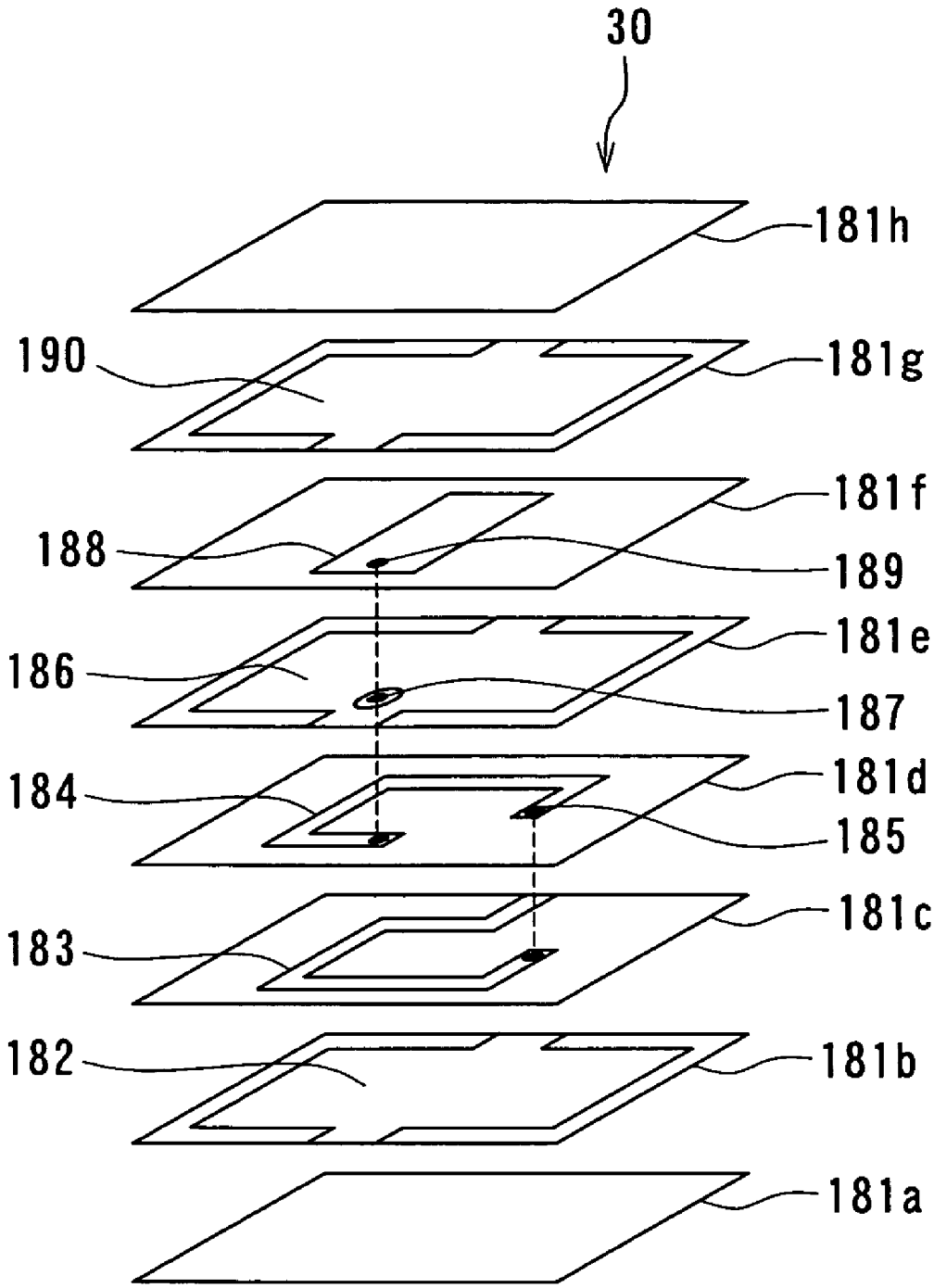
FIG. 38 is an exploded perspective view illustrating an example of configuration of a multi-layer substrate for implementing a resonator having a shape of a fourth example of the third embodiment of the invention.

FIG. 38 is an exploded perspective view illustrating an example of configuration of the multi-layer substrate 30 for implementing the resonator of the fourth example. FIG. 38 illustrates only a portion of the multi-layer substrate 30 near the resonator of the fourth example. The multi-layer substrate 30 of FIG. 38 incorporates eight dielectric layers 181*a* to 181*h* stacked from bottom to top. A conductor layer 182 for ground is formed on the top surface of the dielectric layer 181*b*. A conductor layer 183 for an inductor that has an approximately three-fourths turn is formed on the top surface of the dielectric layer 181*c*. A conductor layer 184 for an inductor that has an approximately three-fourths turn and a through hole 185 connected to an end of the conductor layer 184 are formed on the top surface of the dielectric layer 181*d*. A conductor layer 186 for ground and a through hole 187 are formed on the top surface of the dielectric layer 181*e*. The through hole 187 is not in contact with the conductor layer 186. A conductor layer 188 for a capacitor and a through hole 189 connected to the conductor layer 188 are formed on the top surface of the dielectric layer 181*f*. A conductor layer 190 for ground is formed on the top surface of the dielectric layer 181*g*.

The conductor layer 188 has a width greater than the width of each of the conductor layers 183 and 184. The conductor layer 183 has an end connected to the conductor layers 182, 186 and 190 via a terminal electrode not shown. The conductor layer 183 has the other end connected to an end of the conductor layer 184 via the through hole 185. The conductor layer 184 has the other end connected to the conductor layer 188 via the through holes 187 and 189. The conductor layers 183, 184 and 188 make up the resonator.

The remainder of configuration, operation and effects of the third embodiment are the similar to those of the first or second embodiment.

FOURTH EMBODIMENT

Figure 39:
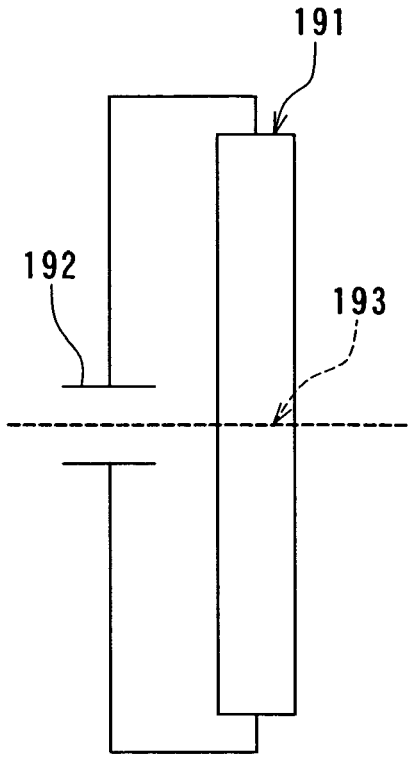
FIG. 39 is a schematic diagram illustrating a circuit made up of a capacitor and a half-wave resonator having open-circuited ends of a fourth embodiment of the invention.
Figure 40:
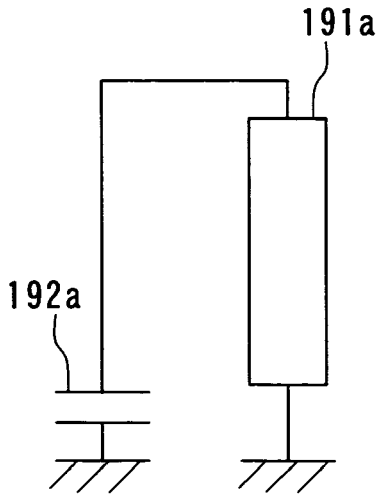
FIG. 40 is a schematic diagram illustrating an equivalent circuit of the circuit of FIG. 39.
Figure 41:
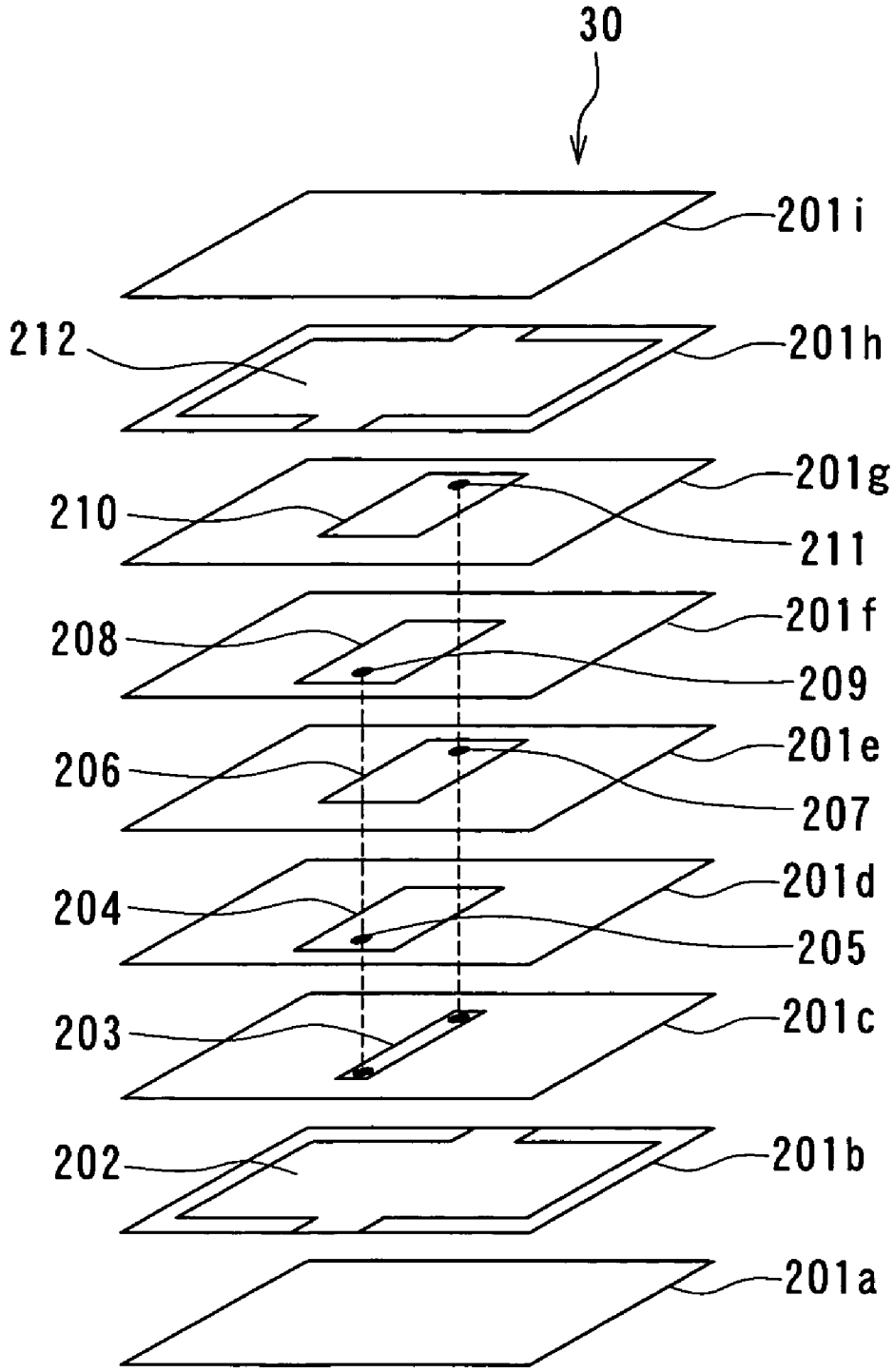
FIG. 41 is an exploded perspective view illustrating an example of configuration of a multi-layer substrate for implementing the circuit made up of the resonator and the capacitor shown in FIG. 39.
Figure 42:
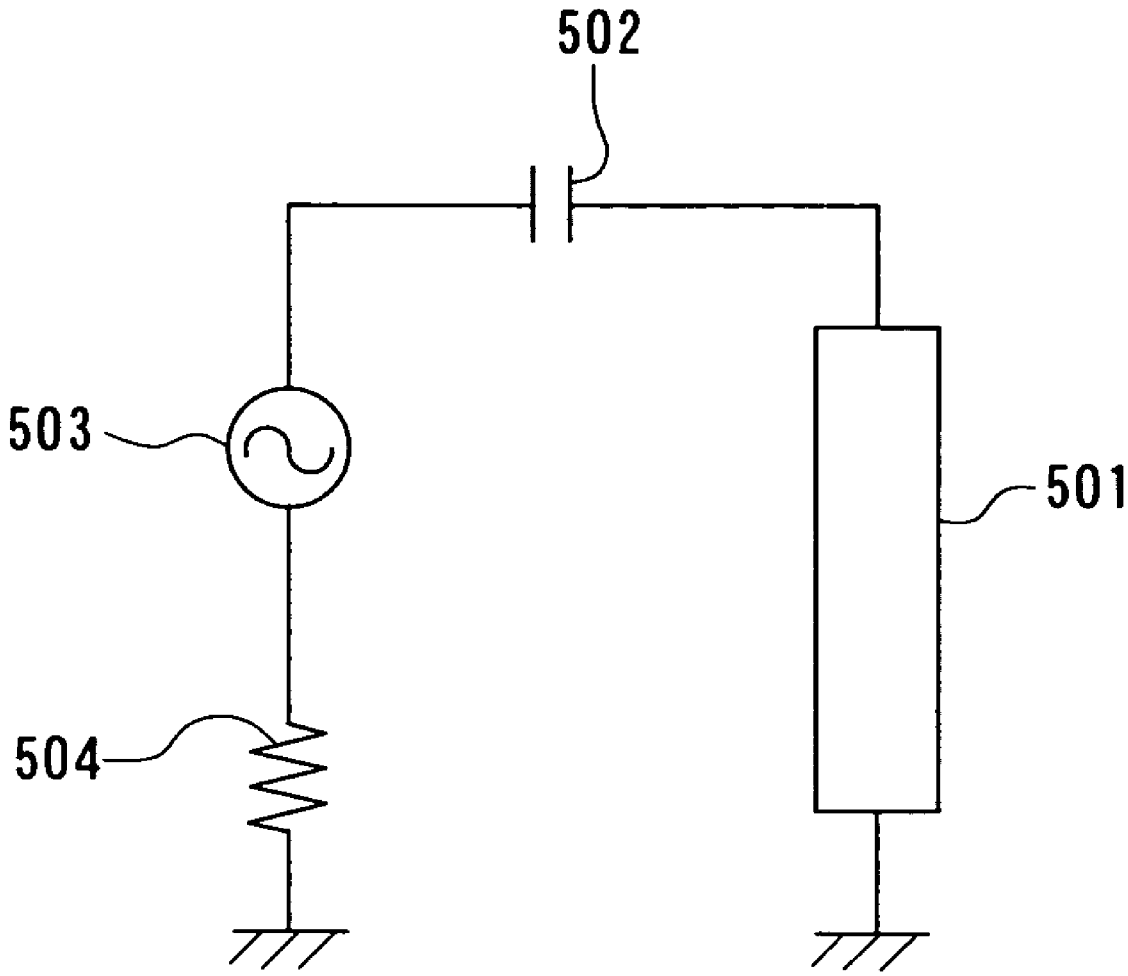
FIG. 42 RELATED ART
FIG. 42 is a schematic diagram for explaining the relationship between the capacitance of a capacitor and an external Q obtained when a signal source is connected to a resonator through the capacitor.

Reference is now made to FIG. 39 to FIG. 41 to describe a multi-layer band-pass filter of a fourth embodiment of the invention. The multi-layer band-pass filter of the fourth embodiment comprises the band-pass filter section 4 of any of the first to third embodiments. According to the embodiment, the band-pass filter section 4 incorporates at least one half-wave resonator 191 having open-circuited ends, the open-circuited ends being connected to each other through a capacitor 192, as shown in FIG. 39. The half-wave resonator 191 may be the half-wave resonator 41A for balanced output, or may be any other half-wave resonator having open-circuited ends.

In FIG. 39, the broken line with numeral 193 indicates the middle position of the length of the half-wave resonator 191 and the middle position between two conductors making up the capacitor 192. In the circuit of FIG. 39, the electric potential is zero in the position indicated with numeral 193. The circuit of FIG. 39 is equivalent of a circuit shown in FIG. 40. The circuit of FIG. 40 incorporates a quarter-wave resonator 191*a* and a capacitor 192*a*. The quarter-wave resonator 191*a* has a short-circuited end grounded. The quarter-wave resonator 191*a* has an open-circuited end connected to an end of the capacitor 192*a*. The other end of the capacitor 192*a* is grounded. The capacitor 192*a* has a capacitance twice the capacitance of the capacitor 192 of FIG. 39.

Therefore, according to the configuration shown in FIG. 39, it is possible to reduce the physical length of the half-wave resonator 191 by using a smaller number of capacitors, compared with the case in which each of the ends of the half-wave resonator 191 is grounded through an individual capacitor.

FIG. 41 is an exploded perspective view illustrating an example of configuration of the multi-layer substrate 30 for implementing the resonator 191 and the capacitor 192 of FIG. 39. FIG. 41 illustrates only a portion of the multi-layer substrate 30 near the resonator 191 and the capacitor 192. The multi-layer substrate 30 of FIG. 41 incorporates nine dielectric layers 201*a* to 201*i* stacked from bottom to top. A conductor layer 202 for ground is formed on the top surface of the dielectric layer 201*b*. A conductor layer 203 that is long in one direction is formed on the top surface of the dielectric layer 201*c*. A conductor layer 204 for a capacitor and a through hole 205 connected to the conductor layer 204 are formed on the top surface of the dielectric layer 201*d*. A conductor layer 206 for a capacitor and a through hole 207 connected to the conductor layer 206 are formed on the top surface of the dielectric layer 201*e*. A conductor layer 208 for a capacitor and a through hole 209 connected to the conductor layer 208 are formed on the top surface of the dielectric layer 20*f*. A conductor layer 210 for a capacitor and a through hole 211 connected to the conductor layer 210 are formed on the top surface of the dielectric layer 201*g*. A conductor layer 212 for ground is formed on the top surface of the dielectric layer 201*h*.

Each of the conductor layers 204, 206, 208 and 210 has a width greater than the width of the conductor layer 203. The conductor layers 204 and 208 are connected via the through holes 205 and 209 to a portion near an end of the conductor layer 203. The conductor layers 206 and 210 are connected via the through holes 207 and 211 to a portion near the other end of the conductor layer 203. The conductor layer 203 makes up the resonator 191 of FIG. 39 and the conductor layers 204, 206, 208 and 210 make up the capacitor 192 of FIG. 39.

The remainder of configuration, operation and effects of the fourth embodiment are the similar to those of the first, second or third embodiment.

The present invention is not limited to the foregoing embodiments but may be practiced in still other ways. For example, the resonators 40 making up the band-pass filter section 4 may have combinations other than the ones disclosed in the foregoing embodiments.

Obviously many modifications and variations of the present invention are possible in the light of the above teachings. It is therefore to be understood that within the scope of the appended claims the invention may be practiced otherwise than as specifically described.

What is claimed is:

1. A multi-layer band-pass filter comprising:

an unbalanced input for receiving unbalanced signals;

a first balanced output and a second balanced output for outputting balanced signals;

a band-pass filter section provided between the unbalanced input and the first and second balanced outputs and incorporating a plurality of resonators each of which is made up of a TEM line; and a multi-layer substrate used for integrating the resonators, wherein the band-pass filter section incorporates, as the resonators, an input resonator to which the unbalanced input is connected, and a half-wave resonator for balanced output to which the first and second balanced outputs are connected, the half-wave resonator for balanced output being made up of a half-wave resonator having open-circuited ends, the multi-layer band-pass filter further comprising a capacitor made up of part of the multi-layer substrate and provided in at least one of a location between the unbalanced input and the input resonator and a location between each of the first and second balanced outputs and the half-wave resonator for balanced output, the capacitor including: a first conductor layer connected to one of the input resonator and the half-wave resonator for balanced output via a through hole; and a second conductor layer opposed to the first conductor layer and connected to one of the unbalanced input, the first balanced output and the second balanced output.

2. The multi-layer band-pass filter according to claim 1, further comprising first and second output capacitors as the capacitor provided between the half-wave resonator for balanced output and the first and second balanced outputs, respectively, wherein the first balanced output is connected through the first output capacitor to an end of a length of the half-wave resonator for balanced output, and the second balanced output is connected through the second output capacitor to the other end of the length of the half-wave resonator for balanced output.

3. The multi-layer band-pass filter according to claim 2, wherein the first output capacitor and the second output capacitor have different capacitances.

4. The multi-layer band-pass filter according to claim 1, wherein the band-pass filter section incorporates at least one half-wave resonator having open-circuited ends, the open-circuited ends being connected to each other through a capacitor.

5. A multi-layer band-pass filter comprising:

an unbalanced input for receiving unbalanced signals;

a first balanced output and a second balanced output for outputting balanced signals;

a band-pass filter section provided between the unbalanced input and the first and second balanced outputs and incorporating a plurality of resonators each of which is made up of a TEM line; and a multi-layer substrate used for integrating the resonators, wherein:

the band-pass filter section incorporates, as the resonators, a half-wave resonator for balanced output that is made up of a half-wave resonator having open-circuited ends, and quarter-wave resonators for balanced output each of which is made up of a quarter-wave resonator, the quarter-wave resonators for balanced output being provided to form one or more stages each of which consists of a pair of the quarter-wave resonators for balanced output, and being disposed between the half-wave resonator for balanced output and the first and second balanced outputs; and the first and second balanced outputs are connected to a pair of the quarter-wave resonators for balanced output of a final stage, respectively, the multi-layer band-pass filter further comprising a capacitor made up of part of the multi-layer substrate and provided in at least one of a location between the unbalanced input and the resonator connected thereto and a location between each of the first and second balanced outputs and the pair of the quarter-wave resonators of the final stage, wherein: the pair of the quarter-wave resonators of the final stage are only provided as the quarter-wave resonators for balanced output; one of the pair of the quarter-wave resonators of the final stage is coupled to one of half portions of the half-wave resonator for balanced output; and the other one of the pair of the quarter-wave resonators of the final stage is coupled to the other one of the half portions of the half-wave resonator for balanced output, the half portions of the half-wave resonator for balanced output being taken along a length thereof.

6. The multi-layer band-pass filter according to claim 5, wherein the pair of the quarter-wave resonators of the final stage are coupled to the half-wave resonator by means of a single coupling method.

7. The multi-layer band-pass filter according to claim 5, wherein one of the pair of the quarter-wave resonators of the final stage is coupled only to one of the half portions of the half-wave resonator, and the other one of the pair of the quarter-wave resonators of the final stage is coupled only to the other one of the half portions of the half-wave resonator.

8. A multi-layer band-pass filter comprising:

an unbalanced input for receiving unbalanced signals;

a first balanced output and a second balanced output for outputting balanced signals;

a band-pass filter section provided between the unbalanced input and the first and second balanced outputs and incorporating a plurality of resonators each of which is made up of a TEM line; and a multi-layer substrate used for integrating the resonators, wherein:

the band-pass filter section incorporates, as the resonators, a half-wave resonator for balanced output that is made up of a half-wave resonator having open-circuited ends, and quarter-wave resonators for balanced output each of which is made up of a quarter-wave resonator, the quarter-wave resonators for balanced output being provided to form one or more stages each of which consists of a pair of the quarter-wave resonators for balanced output, and being disposed between the half-wave resonator for balanced output and the first and second balanced outputs; and the first and second balanced outputs are connected to a pair of the quarter-wave resonators for balanced output of a final stage, respectively, the multi-layer band-pass filter further comprising a capacitor made up of part of the multi-layer substrate and provided in at least one of a location between the unbalanced input and the resonator connected thereto and a location between each of the first and second balanced outputs and the pair of the quarter-wave resonators of the final stage, wherein: a plurality of stages of the quarter-wave resonators for balanced output are provided; one of a pair of the quarter-wave resonators of a first stage closest to the half-wave resonator for balanced output is coupled to one of half portions of the half-wave resonator for balanced output; and the other one of the pair of the quarter-wave resonators of the first stage is coupled to the other one of the half portions of the half-wave resonator for balanced output, the half portions of the half-wave resonator for balanced output being taken along a length thereof.

9. The multi-layer band-pass filter according to claim 8, wherein the pair of the quarter-wave resonators of the first stage are coupled to the half-wave resonator by means of a single coupling method.

10. The multi-layer band-pass filter according to claim 8, wherein one of the pair of the quarter-wave resonators of the first stage is coupled only to one of the half portions of the half-wave resonator, and the other one of the pair of the quarter-wave resonators of the first stage is coupled only to the other one of the half portions of the half-wave resonator.

11. The multi-layer band-pass filter according to claim 8, wherein a pair of the quarter-wave resonators of each of the stages are coupled to a pair of the quarter-wave resonators of a previous or next stage by means of a single coupling method.

12. A multi-layer band-pass filter comprising:

an unbalanced input for receiving unbalanced signals;

a first balanced output and a second balanced output for outputting balanced signals;

a band-pass filter section provided between the unbalanced input and the first and second balanced outputs and incorporating a plurality of resonators each of which is made up of a TEM line; and a multi-layer substrate used for integrating the resonators, wherein:

the band-pass filter section incorporates, as the resonators, a half-wave resonator for balanced output that is made up of a half-wave resonator having open-circuited ends, and quarter-wave resonators for balanced output each of which is made up of a quarter-wave resonator, the quarter-wave resonators for balanced output being provided to form one or more stages each of which consists of a pair of the quarter-wave resonators for balanced output, and being disposed between the half-wave resonator for balanced output and the first and second balanced outputs; and the first and second balanced outputs are connected to a pair of the quarter-wave resonators for balanced output of a final stage, respectively, the multi-layer band-pass filter further comprising a capacitor made up of part of the multi-layer substrate and provided in at least one of a location between the unbalanced input and the resonator connected thereto and a location between each of the first and second balanced outputs and the pair of the quarter-wave resonators of the final stage, wherein the band-pass filter section incorporates at least one half-wave resonator having open-circuited ends, the open-circuited ends being connected to each other through a capacitor.

13. A multi-layer band-pass filter comprising:

an unbalanced input for receiving unbalanced signals;

a first balanced output and a second balanced output for outputting balanced signals;

a band-pass filter section provided between the unbalanced input and the first and second balanced outputs and incorporating a plurality of resonators each of which is made up of a TEM line; and a multi-layer substrate used for integrating the resonators, wherein the band-pass filter section incorporates, as the resonators, an input resonator to which the unbalanced input is connected, and a half-wave resonator for balanced output to which the first and second balanced outputs are connected, the half-wave resonator for balanced output being made up of a half-wave resonator having open-circuited ends, the multi-layer band-pass filter further comprising first and second output capacitors made up of part of the multi-layer substrate and provided between the half-wave resonator for balanced output and the first and second balanced outputs, respectively, wherein:

the first balanced output is connected through the first output capacitor to an end of a length of the half-wave resonator for balanced output, and the second balanced output is connected through the second output capacitor to the other end of the length of the half-wave resonator for balanced output; and the first output capacitor and the second output capacitor have different capacitances.

14. A multi-layer band-pass filter comprising:

an unbalanced input for receiving unbalanced signals;

a first balanced output and a second balanced output for outputting balanced signals;

a band-pass filter section provided between the unbalanced input and the first and second balanced outputs and incorporating a plurality of resonators each of which is made up of a TEM line; and a multi-layer substrate used for integrating the resonators, wherein the band-pass filter section incorporates, as the resonators, an input resonator to which the unbalanced input is connected, and a half-wave resonator for balanced output to which the first and second balanced outputs are connected, the half-wave resonator for balanced output being made up of a half-wave resonator having open-circuited ends, the multi-layer band-pass filter further comprising a capacitor made up of part of the multi-layer substrate and provided in at least one of a location between the unbalanced input and the input resonator and a location between each of the first and second balanced outputs and the half-wave resonator for balanced output, wherein the band-pass filter section incorporates at least one half-wave resonator having open-circuited ends, the open-circuited ends being connected to each other through a capacitor.

* * * * *